US005457450A

United States Patent [19]

Deese et al.

[11] Patent Number: 5,457,450

[45] Date of Patent: Oct. 10, 1995

[54] LED TRAFFIC SIGNAL LIGHT WITH AUTOMATIC LOW-LINE VOLTAGE COMPENSATING CIRCUIT

[75] Inventors: Raymond E. Deese, Corona; David D. Lewis, Yorba Linda, both of Calif.

[73] Assignee: R & M Deese Inc., Anaheim, Calif.

[21] Appl. No.: 55,512

[22] Filed: Apr. 29, 1993

[51] Int. Cl.[6] ..... G08G 1/07

[52] U.S. Cl. ..... 340/912; 340/925; 340/916; 340/931; 340/641; 340/642; 340/660; 340/661; 340/662; 340/663; 362/800

[58] Field of Search ..... 340/925, 912, 340/916, 931, 641, 642, 660, 661, 662, 663; 362/800

[56] References Cited

U.S. PATENT DOCUMENTS

| | | | |
|---|---|---|---|
| 3,452,347 | 6/1969 | Stimson | 340/642 |
| 3,796,951 | 3/1974 | Joseph | 340/642 |
| 3,969,672 | 7/1976 | Wallander et al. | 340/641 |
| 4,017,847 | 4/1977 | Burford et al. | 340/641 |
| 4,211,955 | 7/1980 | Ray | 362/800 |
| 4,298,869 | 11/1981 | Okuno | 340/782 |
| 4,329,625 | 5/1982 | Nishizawa et al. | 315/158 |
| 4,729,076 | 3/1988 | Masami et al. | 362/800 |
| 4,939,426 | 7/1990 | Menard et al. | 362/800 |
| 4,954,822 | 9/1990 | Borenstein | 340/925 |
| 4,965,457 | 10/1990 | Wrobel et al. | 362/249 |
| 5,136,287 | 8/1992 | Borenstein | 340/925 |
| 5,160,201 | 11/1992 | Wrobel | 362/249 |

OTHER PUBLICATIONS

"LED 12" Red Signal & LED Retrofit Kit", Econolite Control Products, Inc., Product Brochure.

I. I. Stanley Co., Inc., Design Drawings for LED Traffic Signal Light.

*Primary Examiner*—Brent Swarthout
*Assistant Examiner*—Daryl C. Pope
*Attorney, Agent, or Firm*—Knobbe, Martens, Olson & Bear

[57] ABSTRACT

The present invention relates to an LED traffic signal light containing numerous LEDs and a voltage compensation circuit which allows the traffic light to operate over a wide range of input power voltages, while generating sufficient light intensity to control traffic at a highway intersection. The voltage compensation circuit achieves these objectives without substantially increasing the power consumption, overall cost, or failure rate of the LED traffic signal light. In the preferred embodiment, the voltage compensation circuit disables or rearranges a first and then a second set of LEDs in the traffic light, as the input power voltage drops below a first and then a second threshold voltage, so that the remaining LEDs will be driven by an increased current and generate a greater overall light intensity than if all of the LEDs were driven by the decreased current that would result from the decreased input power voltage. Also in the preferred embodiment, the LEDs are mounted on a printed circuit board, in a configuration generally corresponding to the shape of the traffic signal light.

27 Claims, 15 Drawing Sheets

LED TRAFFIC SIGNAL LIGHT WITH AUTOMATIC LOW-LINE VOLTAGE COMPENSATING CIRCUIT

BACKGROUND OF THE INVENTION

Traffic signal lights consisting of hundreds of light emitting diodes (LEDs) have recently been developed. These LED traffic signal lights are intended to replace the conventional incandescent light bulbs in ordinary traffic signals. Some of these devices can be mounted in the same housing that is currently used for the incandescent bulbs; and some designs also incorporate the same type of electrical connector, so that these LED traffic signal lights can be used as plug in replacements for incandescent bulbs.

LED traffic signal lights can be designed to produce, with normal line voltage, the same light intensity as incandescent bulbs that are currently used, and to have comparable performance characteristics for different viewing angles. In addition, these LED traffic signal lights have significant advantages over incandescent bulbs. First, most LED traffic lights achieve a dramatic decrease in energy consumption. Such an LED traffic light can use as little as 15% as much energy as an incandescent bulb, although the energy savings for different designs can vary significantly. This energy conservation can save municipalities a substantial amount of money and, not incidentally, help to protect the environment and energy resources. A second major advantage of these LED traffic lights is their reliability. Municipalities typically replace every incandescent bulb in all of their traffic signals every year. In stark contrast, an LED traffic light normally has a useful life of approximately 15 years. There are also less obvious advantages of the LED traffic signal lights over the incandescent bulbs. By way of example, because of the lower energy consumption, the required electrical current capacity and cost for the wiring in new traffic signals is lower.

Although the advantages of LED traffic lights can be readily demonstrated, the different electrical characteristics of the LED over the incandescent bulb has substantially inhibited use of the LED light. Thus, one advantage of the incandescent bulb is that it can generate adequate light intensity to control traffic at a highway intersection despite a substantial drop in the input supply voltage. A typical conventional traffic signal will normally provide 120 volts of input power to an incandescent bulb. When the input supply voltage drops to about 75% of its normal value, an incandescent bulb with red filter can still generate approximately 50% of its normal intensity. Such voltage drops (often referred to as "brownouts") often occur in summer, when the electrical energy resources are overloaded.

In contrast, the intensity of light generated by a typical LED traffic light can decrease to as little as 3% of its normal intensity when the input supply voltage drops to 75% of its normal value. Several LED traffic lights in the prior art simply rectify an input voltage and place this voltage across serial strings of LEDs so that the voltage across each LED drops as the input supply voltage drops. Because of the electrical characteristics of the LEDs used in these LED traffic lights, the intensity of light generated by each LED decreases dramatically as its voltage drop decreases. As a result, Such traffic lights appear very dim when the input supply voltage drops substantially. This results in very dangerous situations, especially in crowded urban or suburban areas, and especially in conditions of reduced visibility.

Whenever the power supply to a given area is disrupted, for whatever reason, so that the supply voltage drops to a brownout condition (approximately 92 volts alternating current (AC)), these LED traffic lights will not produce sufficient light to effectively control traffic.

One prior art approach that has been used in an attempt to solve this problem involves providing a direct current (DC) power supply for each LED traffic signal light, where the power supply can operate over a wide range of input voltages. This approach supplies an approximately constant voltage to the LEDs despite variations in the traffic signal supply voltage. A second approach that has been used involves connecting a resistor and a number of LEDs in series. The resistor limits the current flowing through the LEDs when the input voltage is at its normal value. But when the input voltage drops, the resistor helps to maintain the voltage differential across the LEDs by absorbing a portion of the voltage drop.

SUMMARY OF THE INVENTION

The present invention relates to an LED traffic signal light having one or more automatic low-line voltage compensating circuits. A significant feature of the invention is that the light intensity from the traffic light is maintained at the requisite brightness over a significant voltage fluctuation so that the LED traffic lights remain fully operable during a brownout condition.

One embodiment of the invention involves rectifying the input supply voltage and placing the resulting DC voltage across several strings of LEDs, where each string is connected in series. Each string contains a sufficient number of LEDs so that the voltage drop across each LED is appropriate to generate an adequate overall light intensity for an input voltage between a predetermined threshold voltage and the normal input supply voltage. A control circuit monitors the input supply voltage to determine whether this voltage is greater than or less than the predetermined threshold voltage. When the input supply voltage is less than the predetermined threshold voltage, the voltage compensating circuit effectively shorts a number of the LEDs in each string to ground. Thus, the DC voltage derived from the input supply voltage effectively becomes connected across the remaining LEDs in each string. The number of LEDs shorted to ground is selected so that the voltage drop across each of the remaining LEDs is appropriate to generate an adequate light intensity for a range of input voltages below the threshold voltage.

Preferably, this embodiment contains a second voltage compensating circuit, as described, that operates at a different threshold voltage from the first circuit and shorts out a different group of LEDs from the circuit. Use of this second voltage compensating circuit allows the LED traffic light to operate over a wider range of input supply voltages without allowing the light intensity to drop too low. Additional voltage compensating circuits can be used to allow the LED traffic light to operate over an even wider range of input supply voltages.

A particular feature of the preferred embodiment of the invention is that the candelas of light delivered during a brownout condition are substantially equivalent to those produced with full line voltage. It would appear that with fewer LEDs generating light when the input voltage drops below the threshold voltage, the light output of the stop light would decrease commensurately. In the preferred embodiment of the invention, however, each of the remaining LEDs in the circuit is caused to produce more light than when all of the LEDs are illuminated. This is accomplished by selecting the number of LEDs to be shorted so that the voltage drop across each illuminated LED is greater when some LEDs are shorted to ground than when all LEDs are illuminated. This increased voltage drop causes an increased current, which causes the LEDs to generate an increased light intensity. As a result, during a brownout, fewer LEDs are energized at an increased voltage to compensate for the reduced number of illuminated LEDs.

A second embodiment of the present invention is similar to the first embodiment described above. However, the second embodiment utilizes opto-isolated transistors to rearrange the configuration of LEDs. Instead of shorting a set of LEDs to ground, the second embodiment electronically rearranges the configuration so that more of the LEDs are connected in parallel rather than being connected in series. This arrangement also results in an increased voltage drop across some of the LEDs, which results in an increased current and light generation by those same LEDs.

Another significant advantage of the present invention is that it overcomes the dimming problem for low input supply voltages without sacrificing any of the advantages gained by using LED traffic lights instead of incandescent bulbs. In contrast, the prior art devices that provide a DC power supply for each light not only are more expensive to manufacture than this invention, but they also substantially sacrifice the reliability of the LED traffic lights. Thus, the electrical components in the DC power supplies have a much higher failure rate than the remainder of the components that constitute the LED traffic light. An additional disadvantage of the prior art is that a failure in the DC power supply is likely to immediately disable the entire traffic signal light. In contrast, a failure in the voltage compensation circuit of the present invention is not likely to have any effect on the operation of the traffic light during normal power delivery conditions.

The present invention also has significant advantages over the less complex prior art systems that use a series resistor to limit the current to the LEDs. In addition to the unsatisfactory results of these devices at decreased input supply voltages, such prior art devices also substantially sacrifice the energy savings that can be achieved by LED traffic lights. Especially during normal power conditions, when the input supply voltage is at its full voltage, these prior art devices waste substantial amounts of electrical energy because of the current flowing through the series resistor.

Additional advantages of the present invention are an LED traffic signal light that can easily be mounted and connected within existing traffic signals to replace the currently used incandescent bulbs. This LED traffic light can provide illumination characteristics that are comparable to those of incandescent bulbs over a wide range of viewing angles. The present invention can also operate over a wide range of input supply voltages, while maximizing energy efficiency and overall reliability, and minimizing overall cost. Also, a failure in the voltage compensating circuit is not likely to affect the operation of the traffic signal light, except during conditions of a low input supply voltage.

THE RETROFITTED TRAFFIC SIGNAL LIGHT

Figure 1:
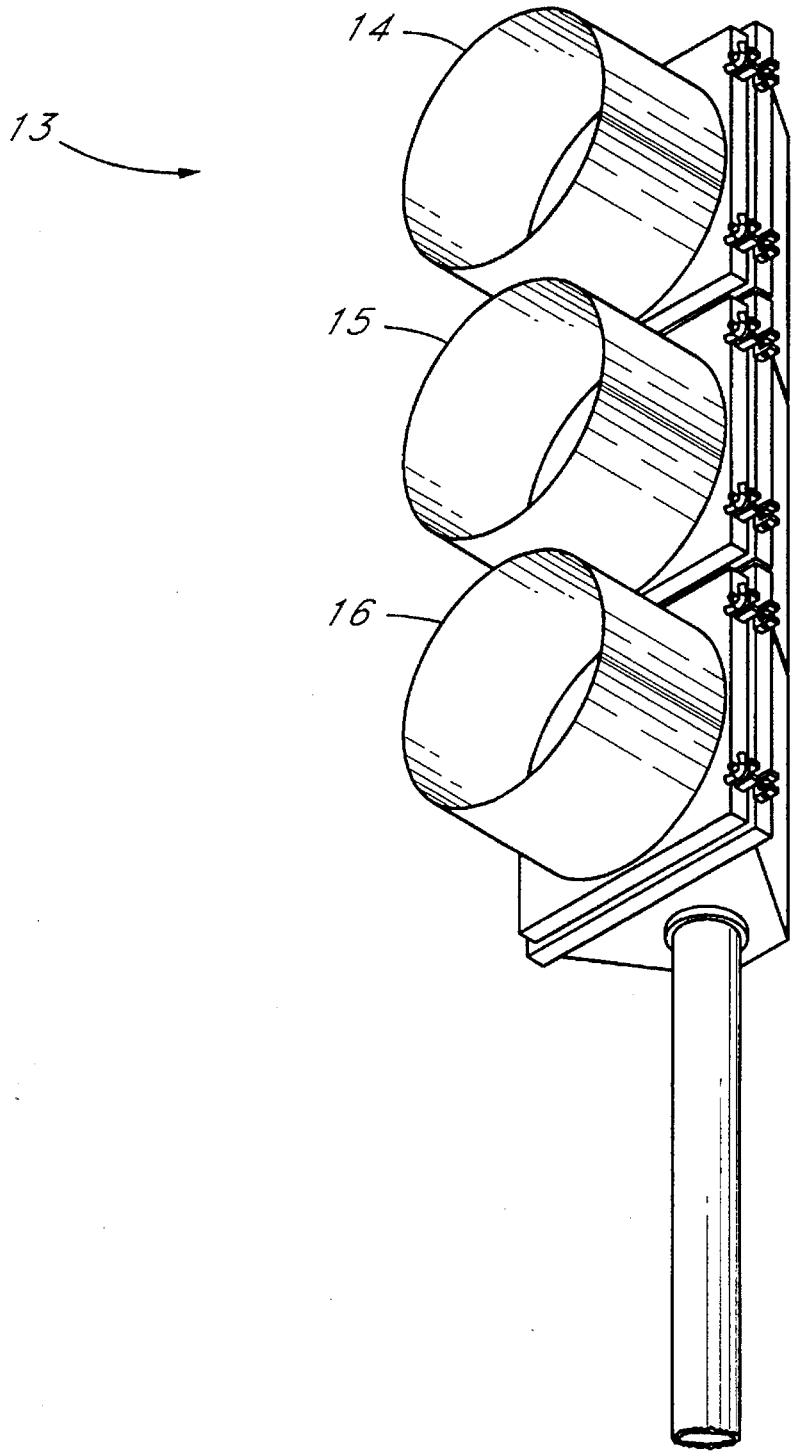
FIG. 1 is a perspective view of a traffic signal containing three traffic signal light assemblies.

FIG. 1 shows a typical, conventional traffic signal 13 with a red traffic light assembly 14, a yellow traffic light assembly 15 and a green traffic light assembly 16 for controlling the flow of traffic at a typical highway intersection.

Figure 2A:
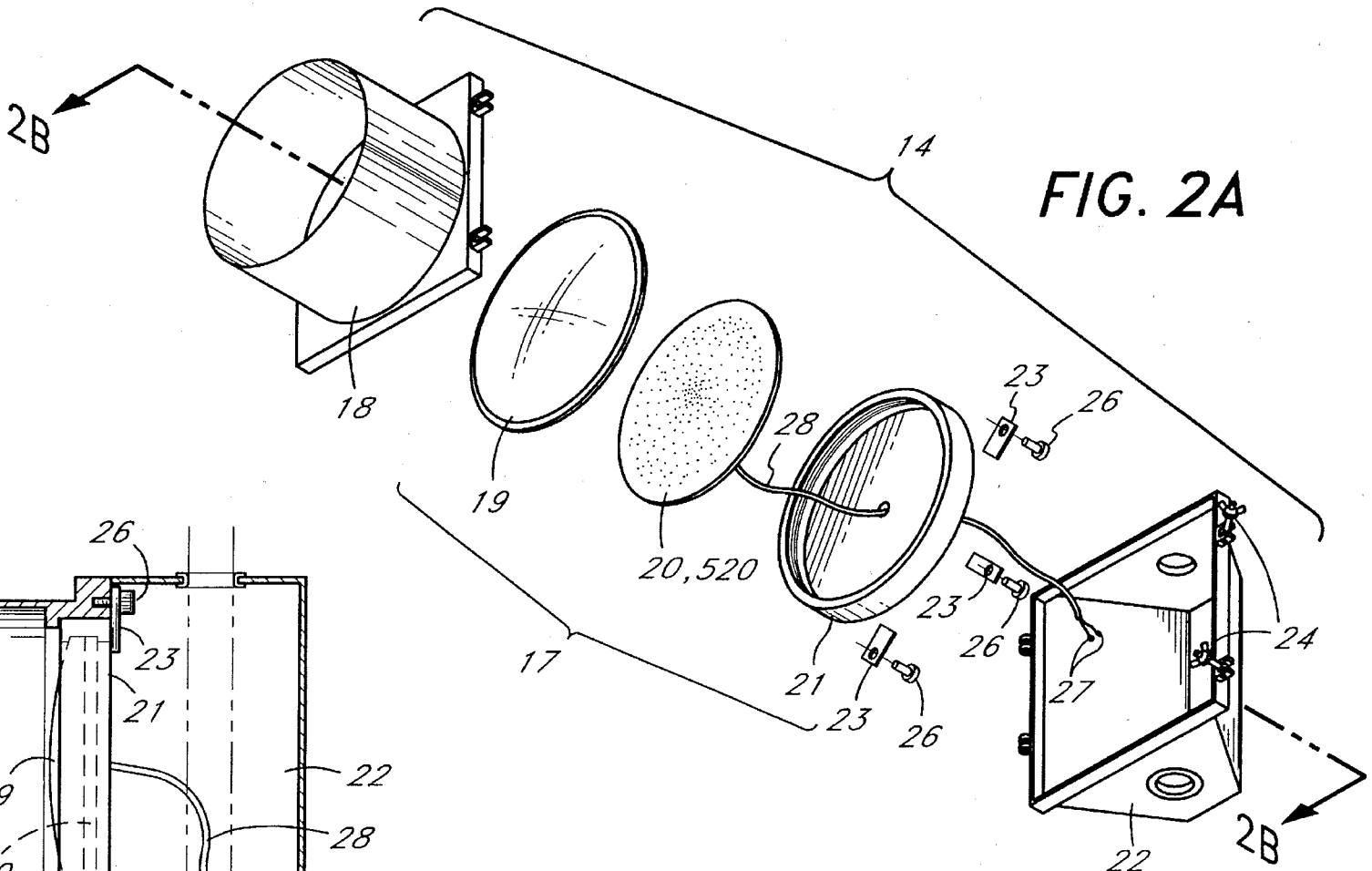
FIG. 2A is an exploded view of one of the traffic signal light assemblies of FIG. 1, containing an LED traffic signal light.

A significant feature of the invention is that the conventional assemblies 14, 15 and 16 that typically contain incandescent light bulbs can be retrofitted with an LED traffic signal light. Referring to FIG. 2A, an exploded view of the red traffic light assembly 14 of FIG. 1 is shown. This red traffic light assembly 14 includes a hinged cover with visor 18, an LED traffic signal light 17, clips 23, mounting screws 26, a traffic light enclosure 22 and a pair of wing nut connectors 24.

The LED traffic signal light 17 comprises a lens 19, the LED configuration and control circuitry 20 or 520, a rubber housing 21, a power cable 28 and a pair of ring terminals 27. The different LED configuration and control circuits 20 and 520 represent two specific embodiments that will be described below. The clips 23, along with the mounting screws 26, retain the LED traffic signal light 17 against the hinged cover 18, while the wing nut connectors 24 hold the hinged cover 18 against the light enclosure 22. The rubber housing 21 forms a water-tight seal around the power cable 28 and another water-tight seal with the lens 19 so as to protect the LED signal light 17 from water and other contaminants.

The specific embodiments described below relate to red traffic lights. It will be apparent that the concepts, as well as substantially all of the implementation details described below, apply equally to a specific implementation of the yellow or green LED traffic light. However, as described in greater detail below, the number and configuration of LEDs in the circuits can easily be varied to compensate for differences in the electro-optical characteristics of the different color LEDs. A person of ordinary skill in the art will easily be able to implement this invention in a yellow or green traffic light using the design guidelines described below.

Figure 2B:
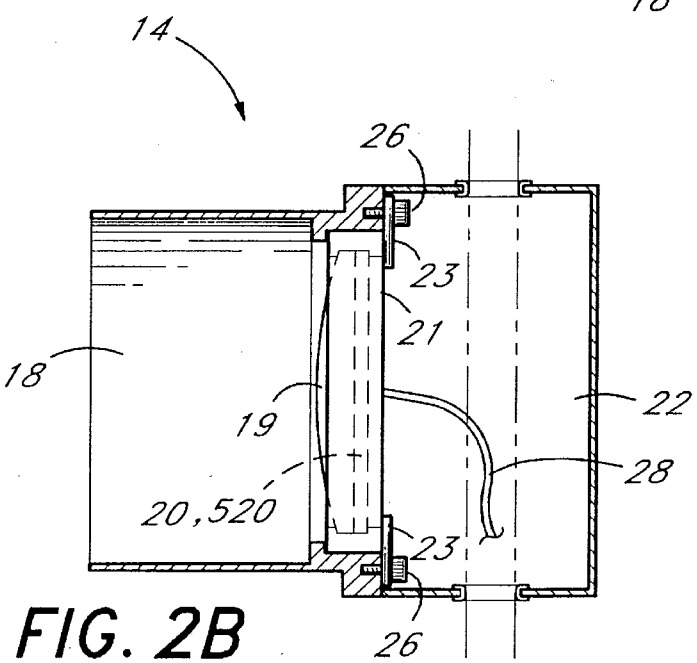
FIG. 2B is a cross-sectional view of the traffic signal light assembly of FIG. 2A.

FIG. 2B shows a cross-sectional view of the red traffic light assembly 14 of FIG. 2A. This figure shows the hinged cover 18, the lens 19, the LED configuration and control circuitry 20 or 520, the rubber housing 21, the power cable 28, a pair of clips 23, a pair of mounting screws 26 and a traffic light enclosure 22.

DETAILED DESCRIPTION OF THE FIRST SPECIFIC EMBODIMENT SHOWN IN FIGS. 3–5

Figure 3:
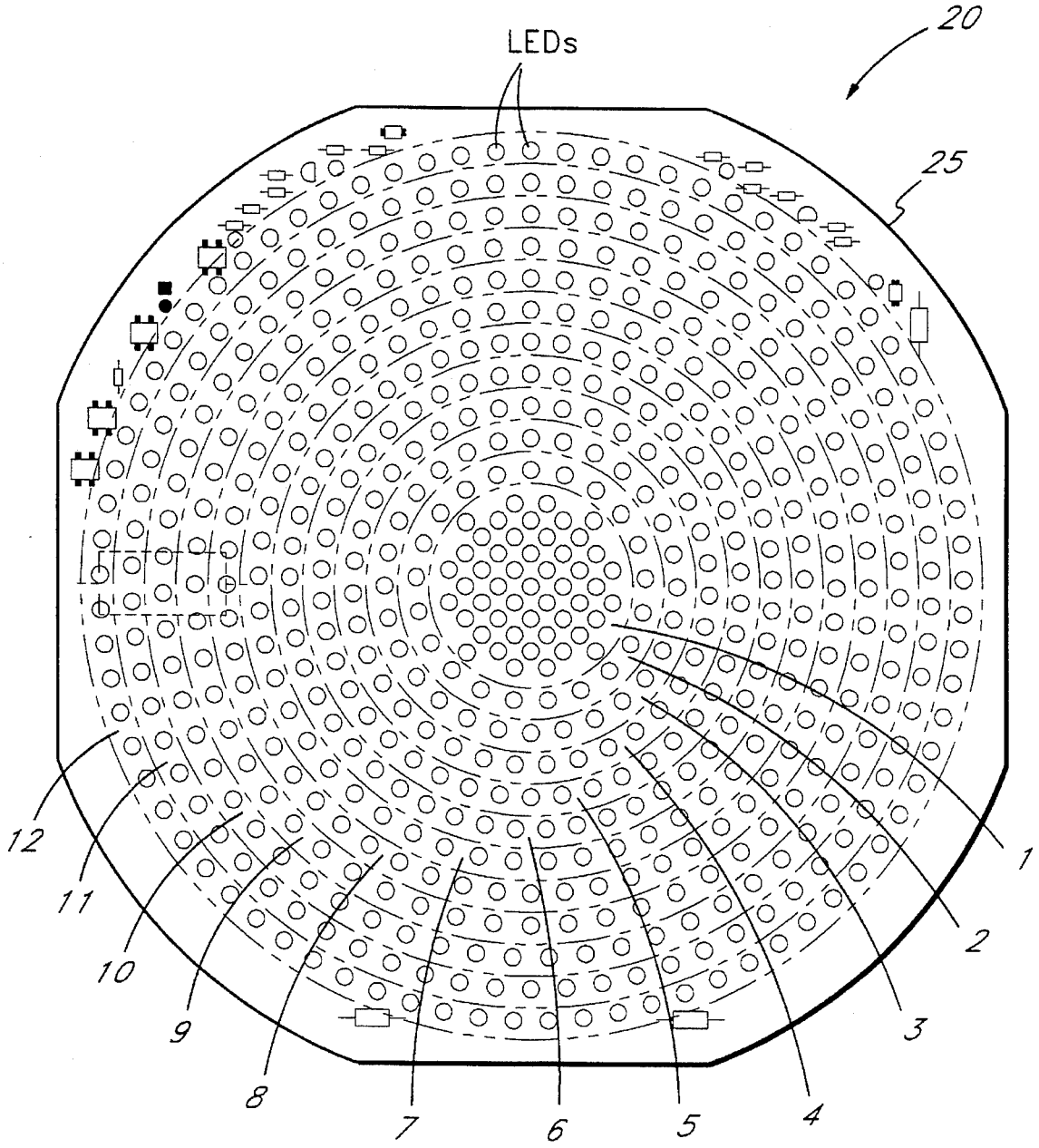
FIG. 3 is a front view of a circuit board containing the LEDs and associated electronic circuitry of a first embodiment of the present invention.

FIG. 3 illustrates one embodiment of the present invention. A generally circular printed circuit board 25, supports 595 LEDs and their associated electronic driver and control circuitry. As described below, the total number of LEDs utilized in traffic lights constructed in accordance with this specific embodiment is actually somewhat greater than are necessary to provide the correct number of candelas of light. The excess LEDs provide both for canceling the effect of a possible failure of a few LEDs during the life of the lamp and also they provide for ample light output during periods of reduced line voltage such as is encountered during brown-out conditions.

The plurality of LEDs is arranged in 12 generally concentric groups, LED arrays 1 to 12. As can be seen in FIG. 3, the LEDs in array 1 are advantageously mounted closer together than the LEDs in the remaining arrays, so that the LEDs are more concentrated near the center of the circuit board 25. This makes the LED traffic light 17 appear brighter to an automobile driver because of a well-known optical illusion effect. It also causes the LED traffic light 17 to appear more like the conventional incandescent light bulb.

Figure 4:
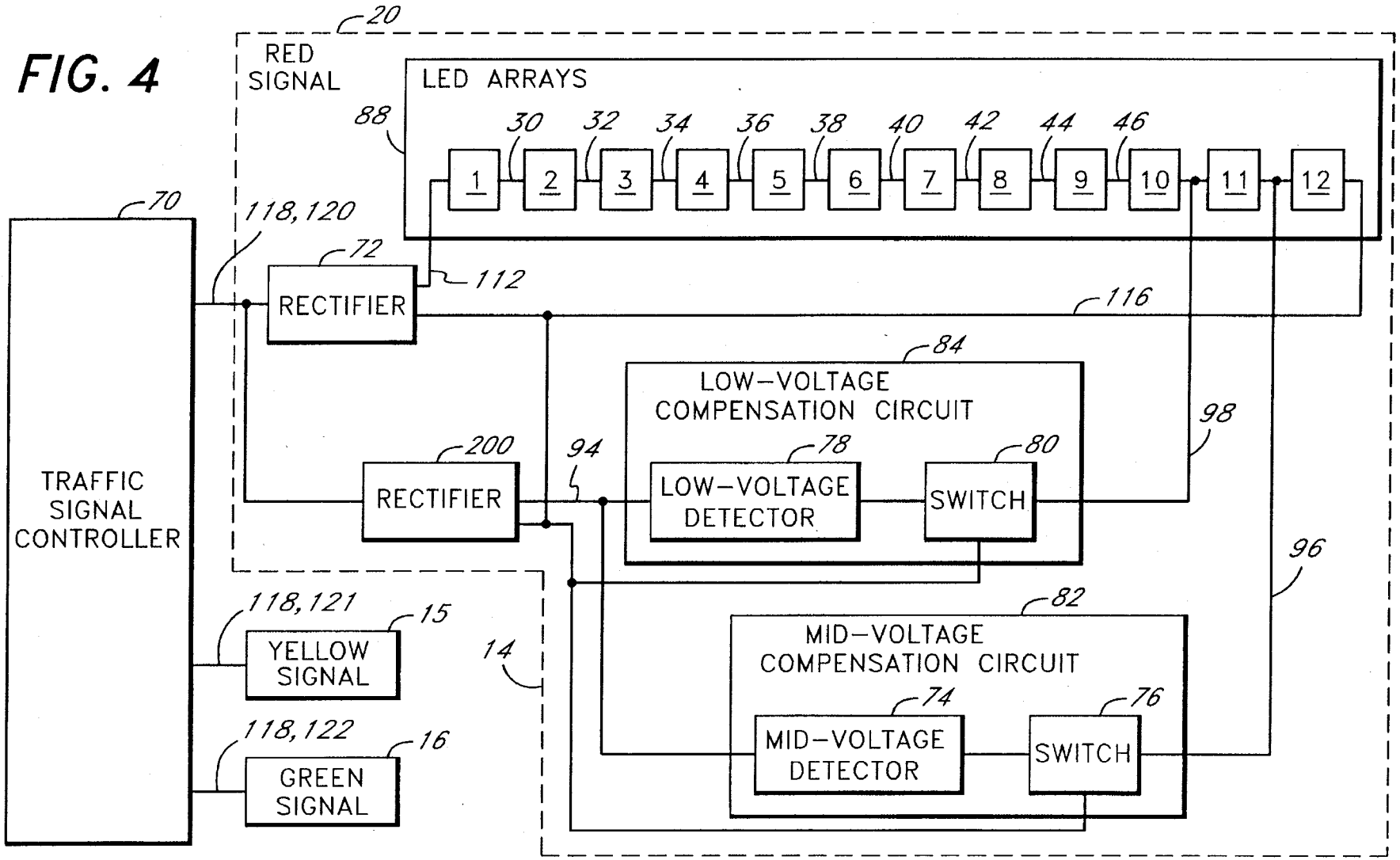
FIG. 4 is a functional block diagram of the first embodiment of the present invention.

FIG. 4 shows a functional block diagram of the LED circuit 20 shown in FIG. 3, in conjunction with additional circuitry of the traffic signal 13. Conventional traffic signal controller 70 selectively energizes the red, yellow and green traffic lights 14, 15 and 16. Thus, the LED circuit 20 of the red LED traffic light 17 is energized by line power delivered via line 118 and return signal line 120. The yellow signal 15 and the green signal 16 are also connected to signal lines 118, and they receive line voltage via return signal lines 121 and 122, respectively. Existing traffic signals in the United States are typically supplied with electrical power at 120 volts AC. Traffic signal controller 70 typically connects line 118 to this line voltage. The traffic signal controller 70 controls the illumination of each of the traffic lights 14, 15 and 16 by selectively connecting the line voltage return lines 120, 121 or 122 to the other side of the AC line voltage. Thus, a traffic light will not be illuminated unless its return signal line is connected to line voltage by controller 70.

The AC power lines 118 and 120 are connected to a rectifier 72 which converts the AC power from the traffic signal controller 70 to DC power. The rectifier 72 generates a DC power voltage between lines 112 and a DC return line 116, which are connected across an LED configuration 88 comprising LED arrays 1 to 12 previously discussed with reference to FIG. 3.

Each LED array 1 to 12 has a positive node or terminal and a negative node or terminal. The DC power line 112 is connected between the positive terminal of LED array 1. A line 30 is connected between the negative terminal of LED array 1 and the positive terminal of LED array 2. A line 32 is connected between the negative terminal of LED array 2 and the positive terminal of LED array 3. A line 34 is connected between the negative terminal of LED array 3 and the positive terminal of LED array 4. A line 36 is connected between the negative terminal of LED array 4 and the positive terminal of LED array 5. A line 38 is connected between the negative terminal of LED array 5 and the positive terminal of LED array 6. A line 40 is connected between the negative terminal of LED array 6 and the positive terminal of LED array 7. A line 42 is connected between the negative terminal of LED array 7 and the positive terminal of LED array 8. A line 44 is connected between the negative terminal of LED array 8 and the positive terminal of LED array 9. A line 46 is connected between the negative terminal of LED array 9 and the positive terminal of LED array 10. A line 98 is connected between the negative terminal of LED array 10 and the positive terminal of LED array 11. A line 96 is connected between the negative terminal of LED array 11 and the positive terminal of LED array 12. The DC return line 116 is connected to the negative terminal of LED array 12.

Figure 4A:
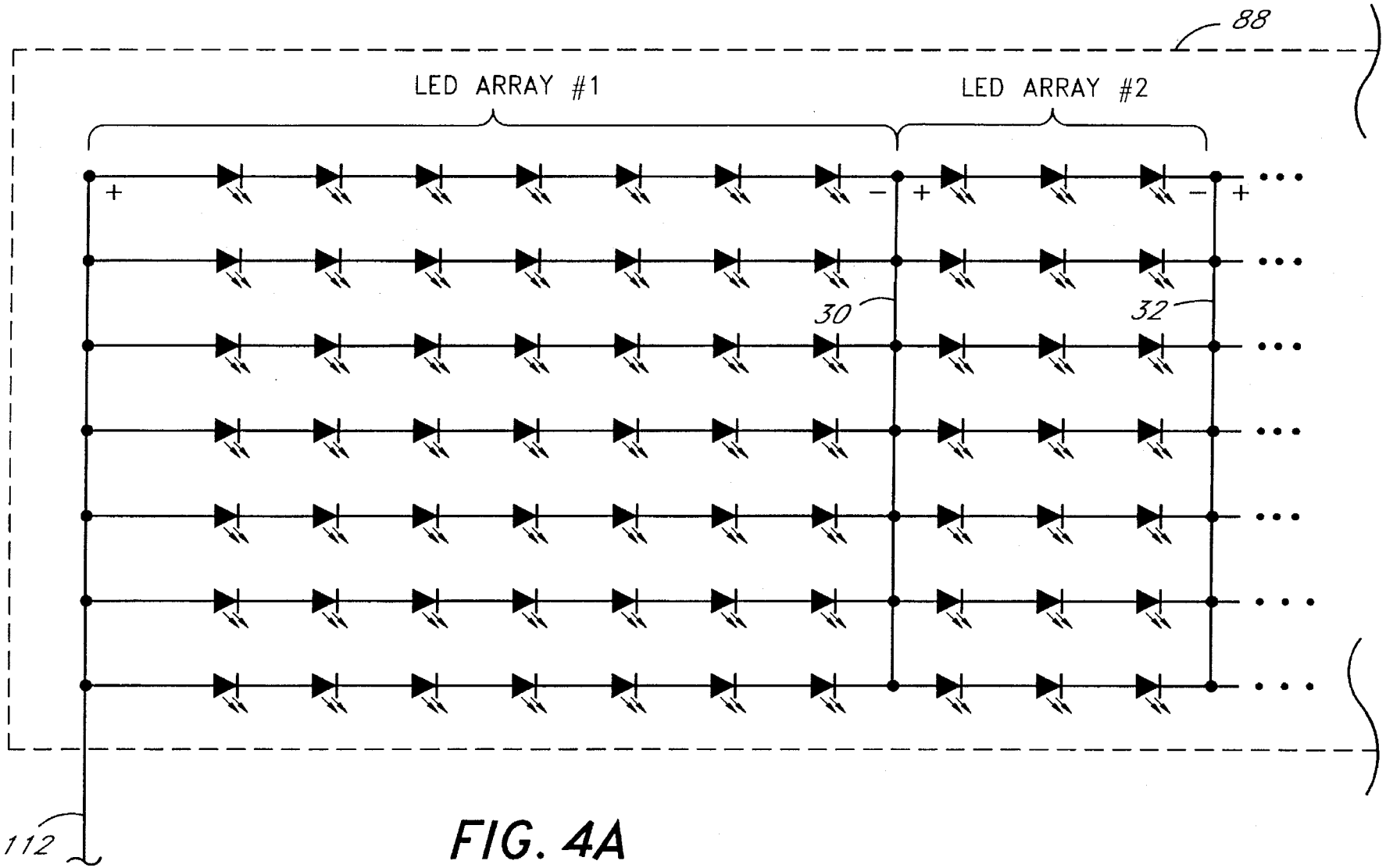
FIG. 4A is a detailed schematic diagram of LED arrays 1 and 2 of FIG. 4.

FIG. 4A shows a schematic diagram of LED arrays 1 and 2, which are representative of the LED arrays 1 to 12 shown in FIGS. 3 and 4. Each LED array 1 to 12 comprises seven strings. Each string is comprised of a set of series connected LEDs. All seven strings in each array are in turn connected in parallel. By way of example, in the specific embodiment shown, the number of LEDs in every string of each array is as follows:

| LED Array | LEDs in Every String |
|---|---|
| 1 | 7 |
| 2 | 3 |
| 3 | 4 |
| 4 | 5 |
| 5 | 6 |
| 6 | 7 |
| 7 | 7 |
| 8 | 8 |
| 9 | 8 |
| 10 | 9 |
| 11 | 10 |
| 12 | 11 |

A series string of LEDs in array 1 is assembled as follows. An anode of a first LED is connected to the positive terminal of the array, which is connected to the DC power line 112. Next, a cathode of the first LED is connected to an anode of a second LED. Each subsequent LED of the string is connected in the same manner, a cathode of one LED connected to an anode of the next LED. After all of the LEDs in the string have been connected in this manner, a cathode of the last LED of the string is connected to the negative terminal of the array 1, which is connected to line 30. Each string in LED array 1 is assembled in this same manner, a series connection of LEDs, from anode to cathode, between the positive and negative terminals of the array, so as to create seven identical strings of LEDs. In addition, the LED strings in each of the other LED arrays 2 to 12 are also assembled in this same manner, a series connection of LEDs, from anode to cathode, between the positive and negative terminals of the respective arrays.

The LEDs of the LED circuit 20 are divided into a relatively large number of LED arrays 1 to 12 so as to limit the number of LEDs that will be disabled because of a failure of one or more LEDs. Thus, if a single LED fails so that there is no continuity from anode to cathode, then no current will flow to or from other LEDs that are in the same string of the same array as the failed LED and this particular string will not be illuminated. The provision of multiple strings, along with numerous arrays, substantially decreases the effect on the overall light emission caused by failure of a few LEDs. Since LEDs are very reliable components, the number of disabled LEDs will rarely, if ever, reach a point that the light intensity generated by the traffic light 17 will substantially decrease. A pattern of disabled LEDs may become apparent to an automobile driver, but will not reduce the effectiveness of the traffic light. It will also be apparent that the design of the embodiment can be modified to provide an even greater number of LED arrays.

A significant feature of the invention is that it retains the substantial advantages of the LED signal light, while overcoming a serious shortcoming of the LED signal light. These advantages include greatly decreased power consumption and greatly increased reliability, thus offering municipalities great cost savings in both much lower electricity bills and lower maintenance. However, heretofore, LED signal lights have had, by virtue of the inherent function of the LED, a significant problem during conditions of reduced power line voltage during a brown-out condition. The present invention provides a very effective solution to this important problem.

Referring again to the specific embodiment of FIG. 4, the line voltage power line 118 and the line voltage return line 120 are also connected to a rectifier 200, which provides a reference voltage 94, representative of the voltage magnitude of the line voltage power line 118. The reference voltage output of the rectifier 200 is provided to both mid-range and low voltage range automatic voltage compensation circuits 82 and 84. Thus, the reference voltage 94 is connected to a mid-voltage detector 74 of the mid-voltage compensation circuit 82. The mid-voltage detector 74 compares the reference voltage 94 against a pre-defined intermediate voltage threshold. In the specific embodiment shown, this intermediate voltage threshold is approximately 107 volts.

When the reference voltage 94 is greater than the intermediate voltage threshold, the mid-voltage detector 74 operates to open a switch 76 connected between line 96 and line 116. Under these circumstances, the mid-voltage compensation circuit 82 has a negligible effect on the operation of the LED arrays 1 to 12. However, when the reference voltage 94 is less than the intermediate voltage threshold, the mid-voltage detector 74 operates to close the switch 76. Under these circumstances, the switch 76 effectively shorts line 96 to the DC return line 116. Because the line 96 is connected to the negative node or terminal of LED array 11 and the positive node or terminal of LED array 12, this effectively removes the LED array 12 from the circuit. Thus, the entire DC voltage generated by the rectifier 72 is effectively connected across only LED arrays 1 to 11.

The low voltage compensation circuit 84 operates in a similar manner to the mid-voltage compensation circuit 82, but the compensation circuit 84 utilizes a different predefined voltage, the low voltage threshold. In this specific embodiment, this voltage will be approximately 96 volts. The reference voltage 94 generated by the rectifier 200 is also connected to a low voltage detector 78. The low voltage detector 78 compares the reference voltage 94 against the low voltage threshold. When the reference voltage 94 is greater than the low voltage threshold, the low voltage detector 78 operates to open a switch 80 connected between line 98 and line 116. Under these circumstances, the low voltage compensation circuit 84 has a negligible effect on the operation of the LED arrays 1 to 12. However, when the reference voltage 94 is less than the low voltage threshold. the low voltage detector 78 operates to close the switch 80. Under these circumstances, the switch 80 effectively shorts the line 98 to the DC return line 116. Because the line 98 is connected to the negative node or terminal of LED array 10 and the positive node or terminal of LED array 11, this effectively removes the LED arrays 11 and 12 from the circuit. Thus, the entire DC voltage generated by the rectifier 72 is effectively connected across LED arrays 1 to 10.

As can be seen from the above description, the LED circuit 20 operates in one of three different modes, depending on the voltage differential provided across the line voltage power signal 118 and the line voltage return signal 120. This voltage has a normal value of 120 volts AC. However, for various reasons, this voltage can drop well below this normal value. Embodiments of the present invention preferably divide the possible values for input power into three different voltage ranges, a low voltage range, an intermediate voltage range and a full voltage range. The full voltage range extends from the normal voltage down to an intermediate voltage threshold. The intermediate voltage range extends from the intermediate voltage threshold down to a low voltage threshold. Any voltage below the low voltage threshold is within the low voltage range. As indicated above, the intermediate voltage threshold is about 107 volts, in this specific embodiment, while the low voltage threshold is about 96 volts.

When the LED circuit 20 is operating in the full voltage mode, all of the LED arrays 1 to 12 are illuminated. The number of LEDs connected in a single series string between the line 112 and the line 116 is selected so that the voltage drop across each LED is appropriate to drive the LEDs with a desired current. The number of series strings is selected to achieve the desired overall light intensity. The desired current is selected to achieve an acceptable reliability for the overall circuit. If an LED is driven at higher currents than is necessary, then the LED will burn out prematurely. Thus, the maximum current rating specified for the LED is derated substantially to select a desired current. The amount of heat generated by an LED for various currents and the total number of LEDs that can be mounted on the printed circuit board should also be considered in selecting a desired current. By way of specific example, each of the LEDs in this specific embodiment is a Toshiba TLRA155BP. A preferable current for these LEDs and this specific embodiment is approximately 30 milliamps. This desired current can be achieved by placing enough LEDs in series to achieve a 2 volt drop across each LED. The DC voltage across lines 112 and 116 will be approximately 170 volts for an input supply voltage of 120 volts AC. Thus, this specific embodiment has 85 LEDs connected in series between line 112 and line 116.

When the LED circuit 20 is operating in the intermediate voltage mode, LED array 12 is disabled, while LED arrays 1 to 11 remain illuminated. As described above, in this mode of operation, the entire voltage differential between line 112 and 116 is connected across LED arrays 1 to 11. Thus, the voltage drop across each LED in arrays 1 to 11 will be greater than the voltage would be if all 12 LED arrays remained in the circuit. This increased voltage drop results in increased current flowing through the LED, which results in increased illumination. The number of LEDs in array 12 is selected so that the increase in current substantially compensates for the reduced input supply voltage to generate substantially the same overall light intensity.

When the LED circuit 20 is operating in the low voltage mode, the LED arrays 11 and 12 are disabled by a low voltage compensation circuit 84 because the input power voltage is below the low voltage threshold. The mid-voltage compensation circuit 82 will also act to disable LED array 12 because the input power voltage is also below the intermediate voltage threshold. In this mode, only the LED arrays 1 to 10 are illuminated. Again, disabling arrays 11 and 12 will cause the LEDs in arrays 1 to 10 to generate an increased light intensity. The number of LEDs in array 11 is selected to substantially compensate for the decreased input supply voltage so that the LED traffic signal light generates substantially the same overall light intensity as it does under conditions of a full line voltage.

The number and configuration of LEDs can be varied to achieve different results that may be required for a different application. In addition, a different number and configuration of LEDs will normally be used for yellow and green LED traffic signal lights because each color of LED typically has different electro-optical characteristics. However, it will be apparent that one of ordinary skill in the art will be able to easily determine an appropriate LED configuration for these embodiments based on the above-described criteria.

A further significant feature of this invention is that not only is the light output of the traffic signal light maintained at a suitable intensity during periods of lowered power line voltage, but such "dim outs" or "brown outs" also have minimal effect on other characteristics of the light signal as viewed by the automobile driver or pedestrians. Referring again to FIG. 3, it can be seen that the LED array 12 forms a generally circular pattern of LEDs around the perimeter of the printed circuit board 25. Thus, when the input supply voltage drops below the intermediate voltage threshold, and LED array 12 is automatically disabled, only the LEDs in the outermost circle will be turned off. The LEDs that remain illuminated, namely arrays 1 to 11, will still form a generally circular pattern. When the input supply voltage drops below the low voltage threshold, and LED array 11 is disabled, only the second ring of LEDs from the outside will be turned off. Again, the LEDs that remain illuminated will form a generally circular pattern. These generally circular patterns are advantageous because they will be more visible to an automobile driver. In addition, the automobile drivers will not be distracted by a different pattern that might otherwise be formed by the LEDs that remain illuminated.

Figure 5:
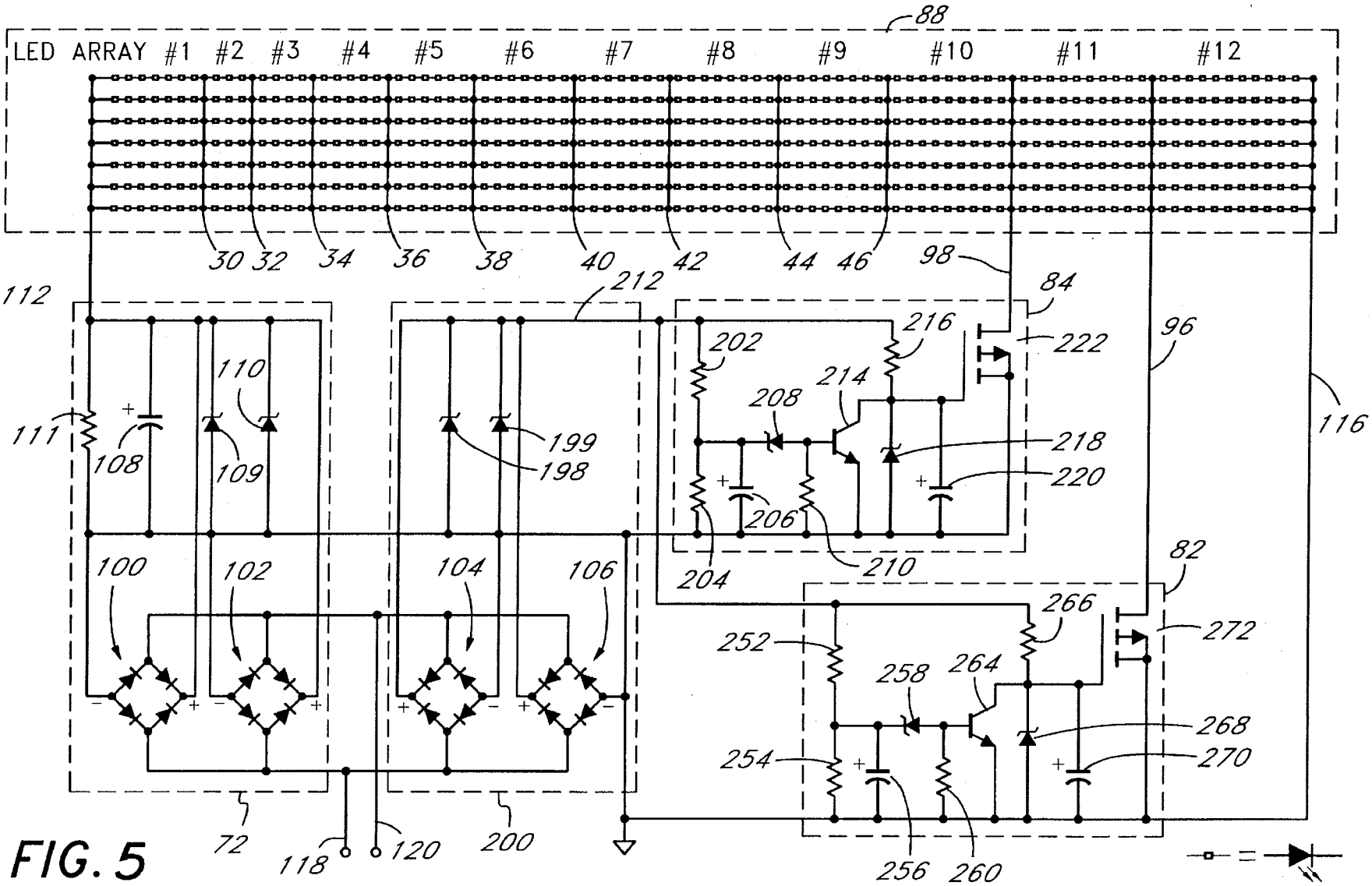
FIG. 5 is a schematic diagram of the first embodiment of the present invention.

Referring to FIG. 5, the rectifier 72, as described above with respect to FIG. 4, comprises a pair of dual in-line package (DIP) bridge rectifiers 100 and 102, a resistor 111, a capacitor 108, and a pair of zener diodes 109 and 110. The line voltage power line 118 is connected to a first AC input terminal of each of the DIP bridge rectifiers 100 and 102. The line voltage return line 120 is connected to a second AC input terminal of each of the DIP bridge rectifiers 100 and 102. A regulated DC power voltage is generated at a positive DC terminal of each of the two DIP bridge rectifiers 100 and 102 and applied to line 112. The regulated DC power is connected via line 112 to a cathode of each of the zener diodes 109 and 110, to a positive terminal of the capacitor 108 and to a first terminal of the resistor 111. A DC return path is provided by line 116 connected to a negative DC terminal of each of the two DIP bridge rectifiers 100 and 102. Lead 116 is connected to an anode of each of the two zener diodes 109 and 110 to a negative terminal of the capacitor 108 and to a second terminal of the resistor 111.

The regulated DC voltage on line 112 is connected to the positive terminal of LED array 1, as described above with respect to FIGS. 4 and 4A. The remaining LED arrays 2 to 12 are also connected as described above, with the negative terminal of LED array 12 connected to the DC return line 116.

The operation of the DIP bridge full wave rectifiers 100 and 102 will be well understood by one skilled in the art. The DIP bridge rectifiers 100 and 102 convert the negative portions of an AC input signal to positive values on the output signal, while allowing the positive portions of the AC input signal to pass through to the output signal, essentially unchanged. Thus, as the voltage differential between the line voltage power line 118 and the line voltage return line 120 oscillates between positive and negative values, the voltage differential across the regulated DC power line 112 and the DC return line 116 remains positive. The capacitor 108 and the resistor 111 provide voltage filtering, as is well known in the art, for the voltage across the regulated DC power line 112 and the DC return line 116. The zener diodes 109 and 110 will typically have a breakdown voltage of approximately 120 volts. These diodes protect the LED circuit 20 from possible damage that could result from a lightning strike. The circuitry in the rectifier 72 provides a relatively clean DC voltage differential between the regulated DC power line 112 and the DC return 116.

Still referring to FIG. 5, the second rectifier 200, described above with respect to FIG. 4, comprises a pair of DIP bridge rectifiers 104 and 106 and a pair of zener diodes 198 and 199. The line voltage power line 118 is connected to a first AC input terminal of each of the DIP bridge rectifiers 104 and 106. The line voltage return line 120 is connected to a second AC input terminal of each of the DIP bridge rectifiers 104 and 106. A positive DC output terminal of each of the DIP bridge rectifiers 104 and 106 generates a first regulated DC reference voltage on line 212. The regulated DC reference on line 212 is connected to a cathode of each of the zener diodes 198 and 199. An anode of each of the zener diodes 198 and 199 and a negative DC output terminal of each of the DIP bridge rectifiers 104 and 106 are all connected to the DC return line 116. The DIP bridge rectifiers 104 and 106 operate in the same manner as the DIP bridge rectifiers 100 and 102, described above, and the zener diodes 198 and 199 operate in the same manner as the zener diodes 109 and 110, also described above.

The second rectifier 200, shown in FIGS. 4 and 5, is substantially independent of the first rectifier 72. As a result, noise produced by the LEDs does not affect the regulated DC reference voltage on line 212, which is used by the voltage compensating circuits 82 and 84. Also, the DIP bridge rectifiers 100, 102, 104 and 106 and the zener diodes 109, 110, 198 and 199 are implemented in pairs for purposes of redundancy. If any one of these components fails, there will be another component to perform the required function. This redundancy substantially increases the overall reliability of the LED circuit 20.

The mid-voltage compensation circuit 82, described above with respect to FIG. 4, comprises, as shown in FIG. 5, four resistors 252, 254, 260 and 266; two capacitors 256 and 270; two zener diodes 258 and 268; a bipolar transistor 264; and a Field Effect Transistor (FET) 272. The regulated DC reference voltage on line 212 is connected to a first terminal of the resistor 252 and to a first terminal of the resistor 266. A second terminal of the resistor 252 is connected to a first terminal of the resistor 254, a positive terminal of the capacitor 256 and a cathode of the zener diode 258. A second terminal of the resistor 254 and a negative terminal of the capacitor 256 are connected to the DC return line 116. An anode of the zener diode 258 is connected to a first terminal of the resistor 260 and to a base terminal of the transistor 264. A second terminal of the resistor 260 and an emitter terminal of the transistor 264 are connected to the DC return line 116. A collector terminal of the transistor 264 is connected to a second terminal of the resistor 266, to a cathode of the zener diode 268, to a positive terminal of the capacitor 270 and to a gate terminal of the transistor 272. An anode of the zener diode 268, a negative terminal of the capacitor 270 and a source terminal of the transistor 272 are all connected to the DC return line 116. A drain terminal of the transistor 272 is connected to the line 96, which is, in turn, connected to the negative terminal of LED array 11 and the positive terminal of LED array 12.

The low voltage compensation circuit 84, described above with respect to FIG. 4, comprises four resistors 202, 204, 210 and 216; two capacitors 206 and 220; two zener diodes 208 and 218; a bipolar transistor 214; and a FET 222. The regulated DC reference signal 212 is connected to a first terminal of the resistor 202 and to a first terminal of the resistor 216. A second terminal of the resistor 202 is connected to a first terminal of the resistor 204, to a positive terminal of the capacitor 206 and to a cathode of the zener diode 208. A second terminal of the resistor 204 and a negative terminal of the capacitor 206 are both connected to the DC return line 116. An anode of the zener diode 208 is connected to a first terminal of a resistor 210 and to a base terminal of the transistor 214. A second terminal of the resistor 210 and an emitter terminal of the transistor 214 are both connected to the DC return line 116. A collector terminal of the transistor 214 is connected to a second terminal of the resistor 216, to a cathode of the zener diode 218, to a positive terminal of the capacitor 220 and to a gate terminal of the transistor 222. An anode of the zener diode 218, a negative terminal of the capacitor 220, and a source terminal of the transistor 222 are all connected to the DC return line 116. A drain terminal of the transistor 222 is connected to the line 98, which is, in turn, connected to the negative terminal of LED array 10 and the positive terminal of LED array 11.

The resistors 252 and 254 function as a voltage divider to provide a voltage to the cathode of the zener diode 258 that is representative of the regulated DC reference signal 212, which, in turn, is representative of the input power voltage across lines 118 and 120. The resistance values for resistors 252 and 254 and the breakdown voltage for zener diode 258 are selected so that the voltage at the cathode of the zener diode 258 is approximately equal to the breakdown voltage of the zener diode 258 when the input supply voltage is equal to the intermediate voltage threshold. Therefore, when the input supply voltage is greater than the intermediate voltage threshold, the zener diode 258 will conduct current into the base of the transistor 264, which will turn on the transistor 264. Under these circumstances, the emitter of the transistor 264 will be pulled low, which will turn off the transistor 272. When the transistor 272 is turned off, very little current will flow into the drain of the transistor 272, and the voltage compensating circuit 82 will have very little effect on the LED arrays 1 to 12.

When, however, the input supply voltage drops below the intermediate voltage threshold, the zener diode 258 will not conduct current into the base of the transistor 264, and so the transistor 264 will be turned off. Under these circumstances, the emitter of the transistor 264 will not conduct, and the resistor 266 will pull the voltage at the emitter of the transistor 264 up to the breakdown voltage of the zener diode 268. This, in turn, will turn on the transistor 272, so that the drain is effectively shorted to the source. This situation effectively shorts line 96 at the positive terminal of the LED array 12 to the DC return line 116, which effectively removes the LED array 12 from the circuit. The voltage of the regulated DC power signal 112 will now effectively be placed across LED arrays 1 to 11.

The preferred embodiment of the present invention has been described so that the transistors 264, 272, 214 and 222 switch between their cut-off region and their saturation region. However, the voltage compensation circuits can also be designed to bias the transistors 264, 272, 214 and 222 in their active regions, when the input supply voltage is near the appropriate threshold voltage. Such a design would cause the disabling of LED arrays 11 and 12 to be more gradual. As the input supply voltage drops below a threshold voltage, the LEDs to be disabled will gradually dim before being turned off completely.

In combination, the resistors 252 and 254 and the zener diode 258 detect when the input supply voltage drops below the intermediate voltage threshold. The transistor 272 operates as the switch 76 shown in FIG. 4. The transistor 264 acts as an inverter to allow the zener diode 258 to activate the transistor 272 with the correct polarity. Thus, when the input supply voltage drops below the intermediate voltage threshold, the zener diode 258 causes the transistor 272 to short line 96 at the positive terminal of the LED array 12 to the DC return line 116, effectively removing the LED array 12 from the circuit. Conversely, when the input supply voltage remains above the intermediate voltage threshold, the zener diode 258 causes the transistor 272 to act as an open switch, so that the voltage compensation circuit 82 has an insignificant effect on the operation of the LED arrays 1 to 12.

The components of the low voltage compensating circuit 84 operate in the same manner as the components of the intermediate voltage compensating circuit 82 to effectively short line 98 at the positive terminal of the LED array 11 to the DC return line 116 when the input supply voltage drops below the low voltage threshold. The resistance values of the resistors 202 and 204, and the breakdown voltage of the zener diode 208, must be selected to cause the zener diode to stop conducting when the input supply voltage drops below the low voltage threshold, instead of the intermediate voltage threshold.

A feature of the specific embodiment shown is that its operation is substantially independent of ambient temperature variations. Thus, in the preferred embodiment of the present invention, the zener diodes 258 and 208 have a breakdown voltage of 6.2 volts. This particular breakdown voltage was selected so that the zener diode would have a voltage temperature differential of zero, so that the breakdown voltage of the zener diode will remain approximately constant for varying ambient temperatures.

For the specific embodiment described above, the resistors 252 and 202 are 100 kilo-ohm resistors with a 5% tolerance. The resistors 254 and 204 have a tolerance of 1%. The value for resistors 254 and 204 will be chosen separately for each light that is assembled. This value is chosen to compensate for the tolerance so the other electrical components in the voltage compensation circuits 82 and 84, and to cause the transistors 264 and 214 to switch between the saturation and cut-off regions when the input supply voltage is at the respective threshold voltage. The resistors 254 and 204 will typically have values between 6 kilo-ohms and 8 kilo-ohms.

Figure 6:
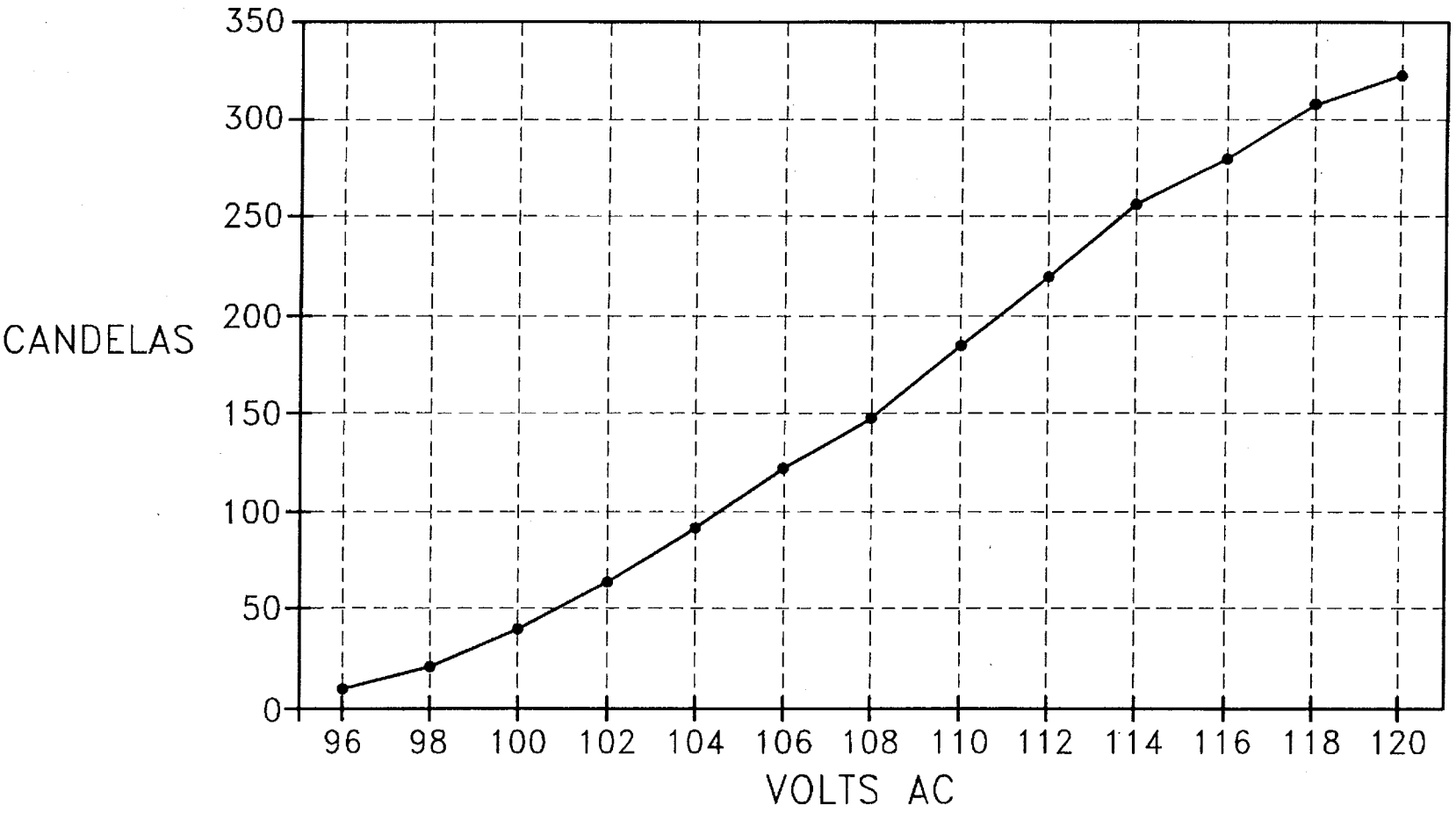
FIG. 6 is a graph showing the intensity of light generated by a typical prior art LED traffic signal light for various input supply voltages.
Figure 7:
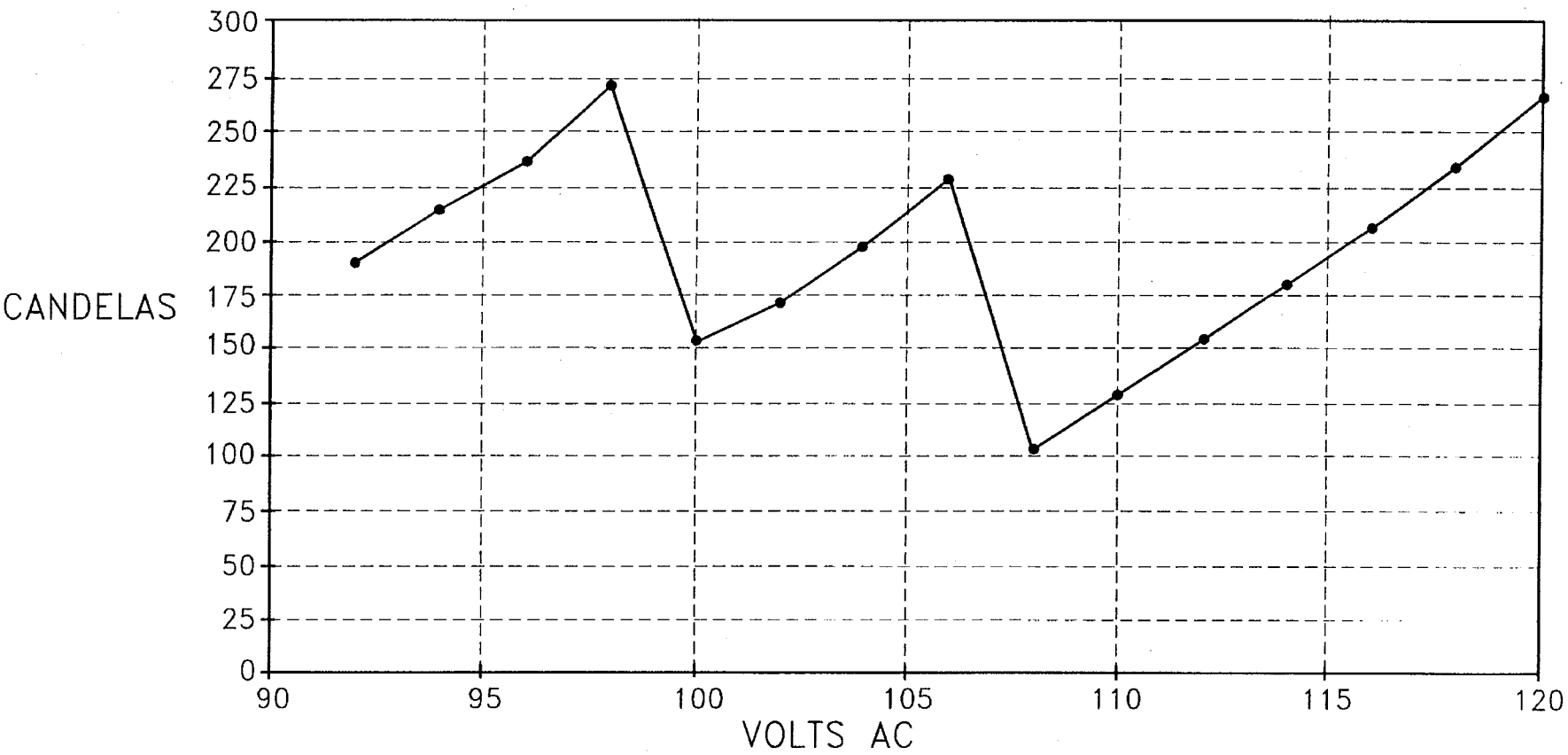
FIG. 7 is a graph showing the intensity of light generated by the first embodiment of the present invention for various input supply voltages.

The overall functioning of the voltage compensation features of this invention is illustrated by FIGS. 6 and 7. FIG. 6 shows a graph of the light intensity generated by a typical prior art LED traffic signal light for a variety of input supply voltages. The light intensity is shown in candelas, while the input supply voltage is shown in AC volts. The prior art LED traffic signal light does not have any means for compensating for a drop in the input supply voltage. As can be clearly seen in FIG. 6, the light intensity generated by the prior art device when the input supply voltage drops to 96 volts AC is a small fraction of the light intensity generated when the input supply voltage is at 120 volts AC. An automobile driver would generally not be able to determine whether the traffic light was turned on when the traffic light becomes this dim.

FIG. 7 shows a graph of the light intensity generated by the above-described embodiment of the present invention for a variety of input supply voltages. Again, the light intensity is shown in candelas, while the input supply voltage is shown in AC volts. FIG. 7 shows that the light intensity generated by this embodiment does not drop below 100 candelas, even thought the input supply voltage drops to a value of 92 volts AC. Thus, traffic signal lights constructed in accordance with the present invention will provide much better traffic control during brownout conditions than will the prior art device.

As described above, the preferred low voltage threshold will be approximately 96 volts. The specific embodiment represented in FIG. 7 has a low voltage threshold of approximately 99 volts. Shifting the low voltage threshold to the preferred value of 96 volts will still produce a satisfactory illumination for input supply voltages as low as 90 volts, without driving the LEDs with as much current as the embodiment represented in FIG. 7. This will decrease the probability of a LED failure.

DETAILED DESCRIPTION OF THE PREFERRED EMBODIMENT OF FIGS. 8–11

Figure 8:
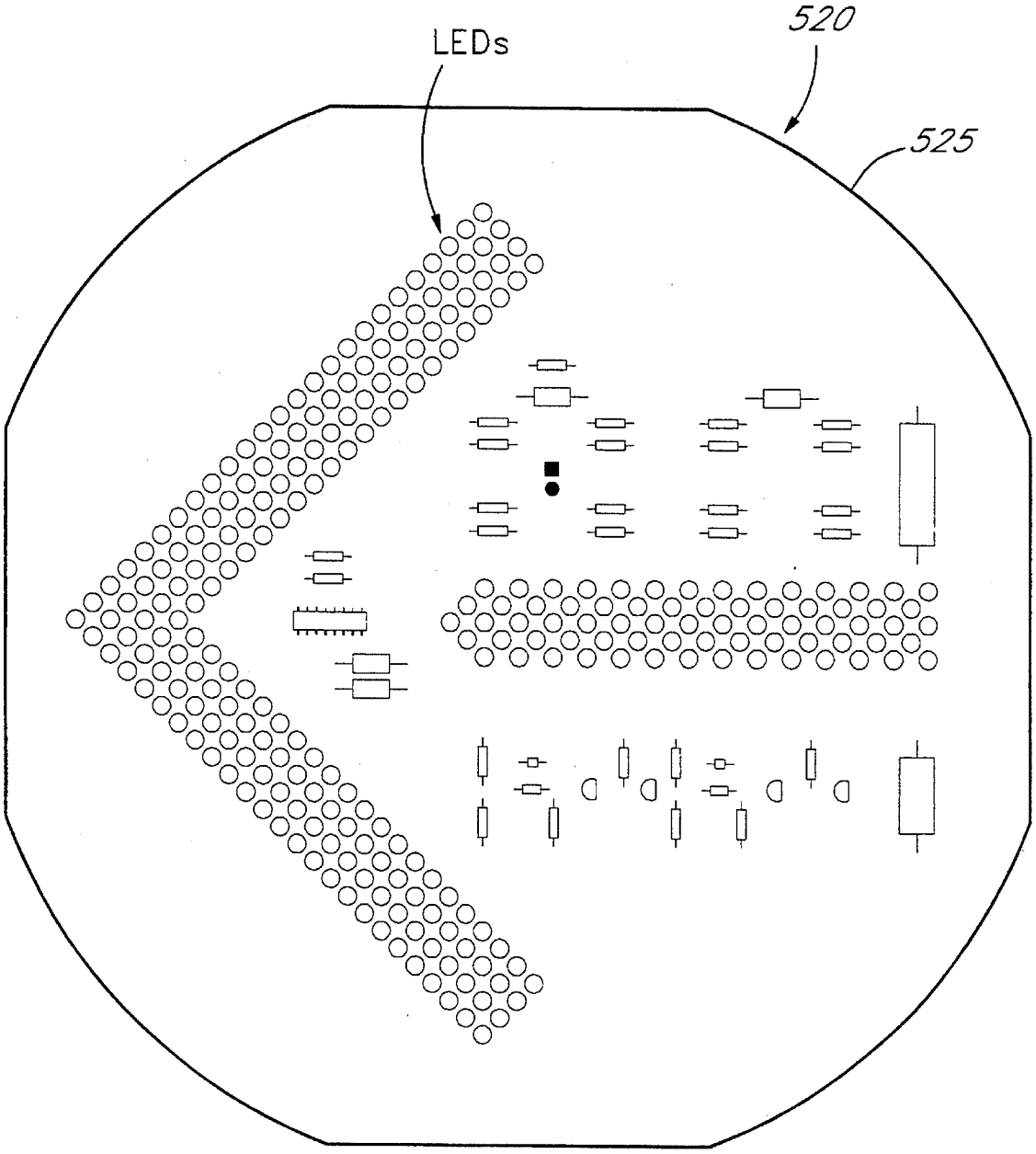
FIG. 8 is a front view of a circuit board containing the LEDs and associated electronic circuitry of a second embodiment of the present invention.

FIG. 8 illustrates a second and preferred embodiment of the present invention. This second embodiment can also be mounted in a typical, conventional traffic signal 13. A LED configuration and control circuitry 520 can simply replace the LED circuit 20 as shown in FIGS. 2A and 2B. A generally circular printed circuit board 525 supports 255 LEDs and their associated driver and control circuitry. The plurality of LEDs is arranged on the printed circuit board 525 to form an arrow. A printed circuit board 525 with this configuration of LEDs can be used in traffic signals that contain either a left turn arrow or a right turn arrow. The voltage compensation circuits for this embodiment, as will be described below, can also be used with the concentric circle configuration of LEDs shown in FIG. 3.

Figure 9:
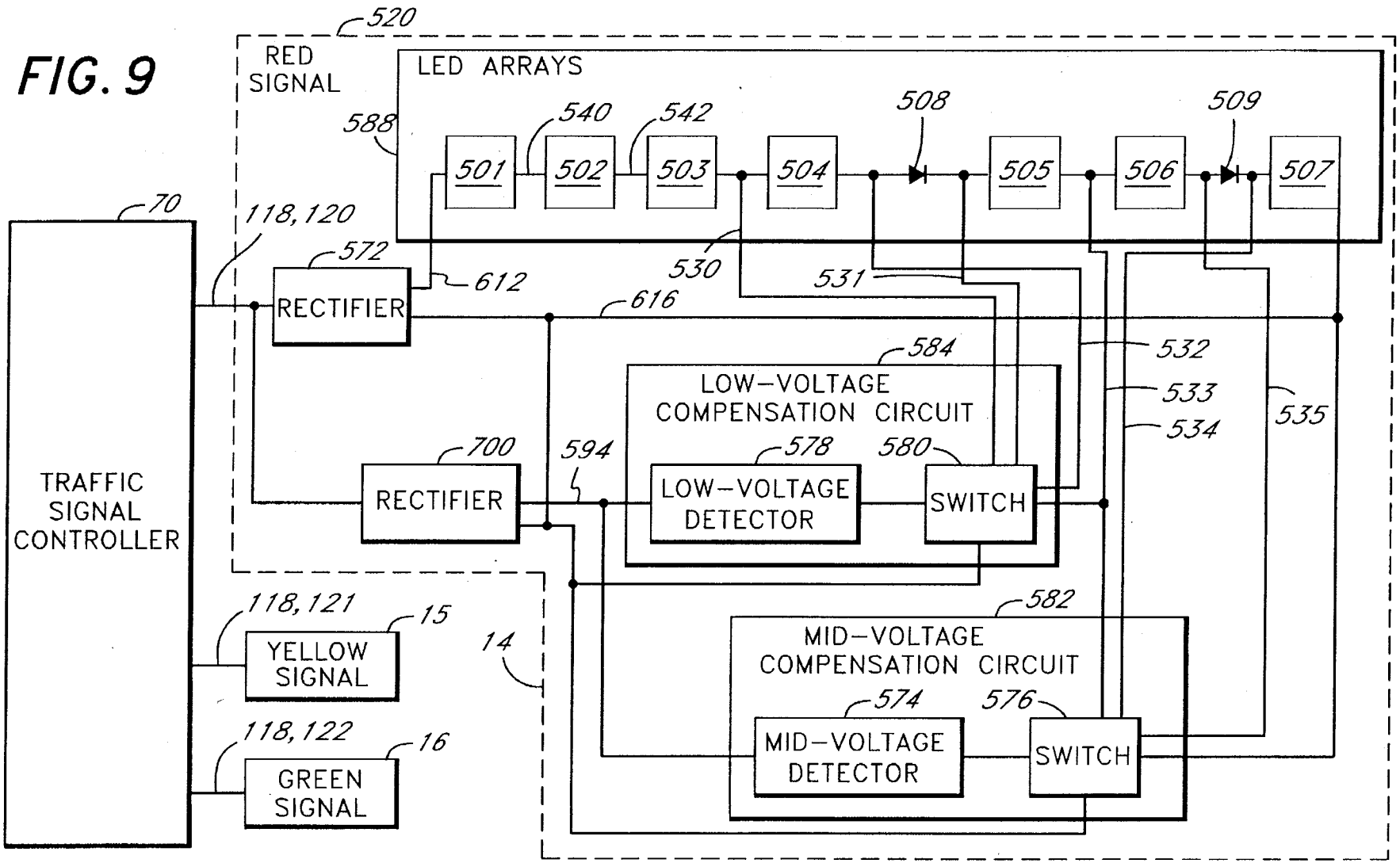
FIG. 9 is a functional block diagram of the second embodiment of the present invention.

FIG. 9 shows a functional block diagram of the LED configuration and control circuitry 520 shown in FIG. 8, in conjunction with additional circuitry of a traffic signal 13. The LED circuit 520 operates in the same manner as LED circuit 20 of the first embodiment, except for a pair of switches 576 and 580 and an LED configuration 588. These differences in operation will be described below. Again, a conventional traffic signal controller 70 selectively energizes the red, yellow and green traffic lights 14, 15 and 16 in the same manner as described with respect to the first embodiment. Lines 118 and 120 are connected between the traffic signal controller, the rectifier 572 and the rectifier 700. The lines 118 and 121 are connected between the traffic signal controller 70 and the yellow signal 15. The lines 118 and 122 are connected between the traffic signal controller 70 and the green signal 16.

The AC power lines 118 and 120 are connected to a rectifier 572 which generates a DC power voltage between line 612 and a DC return line 616. Lines 612 and 616 are connected across an LED configuration 588 comprising LED arrays 501 to 507 and diodes 508 and 509. LED arrays 504 and 505 are separated by a diode 508, while LED arrays 506 and 507 are separated by a diode 509.

Each LED array 501 to 507 has a positive node or terminal and a negative node or terminal. The DC power line 612 is connected between the positive terminal of LED array 501. A line 540 is connected between the negative terminal of LED array 501 and the positive terminal of LED array 502. A line 542 is connected between the negative terminal of LED array 502 and the positive terminal of LED array 503. A line 530 is connected between the negative terminal of LED array 503 and the positive terminal of LED array 504. A line 532 is connected between the negative terminal of LED array 504 and an anode of a diode 508. A line 531 is connected between a cathode of diode 508 and the positive terminal of LED array 505. A line 533 is connected between the negative terminal of LED array 505 and the positive terminal of LED array 506. A line 535 is connected between the negative terminal of LED array 506 and an anode of a diode 509. A line 534 is connected between a cathode of diode 509 and the positive terminal of LED array 507. The DC return line 616 is connected to the negative terminal of LED array 507.

Figure 9A:
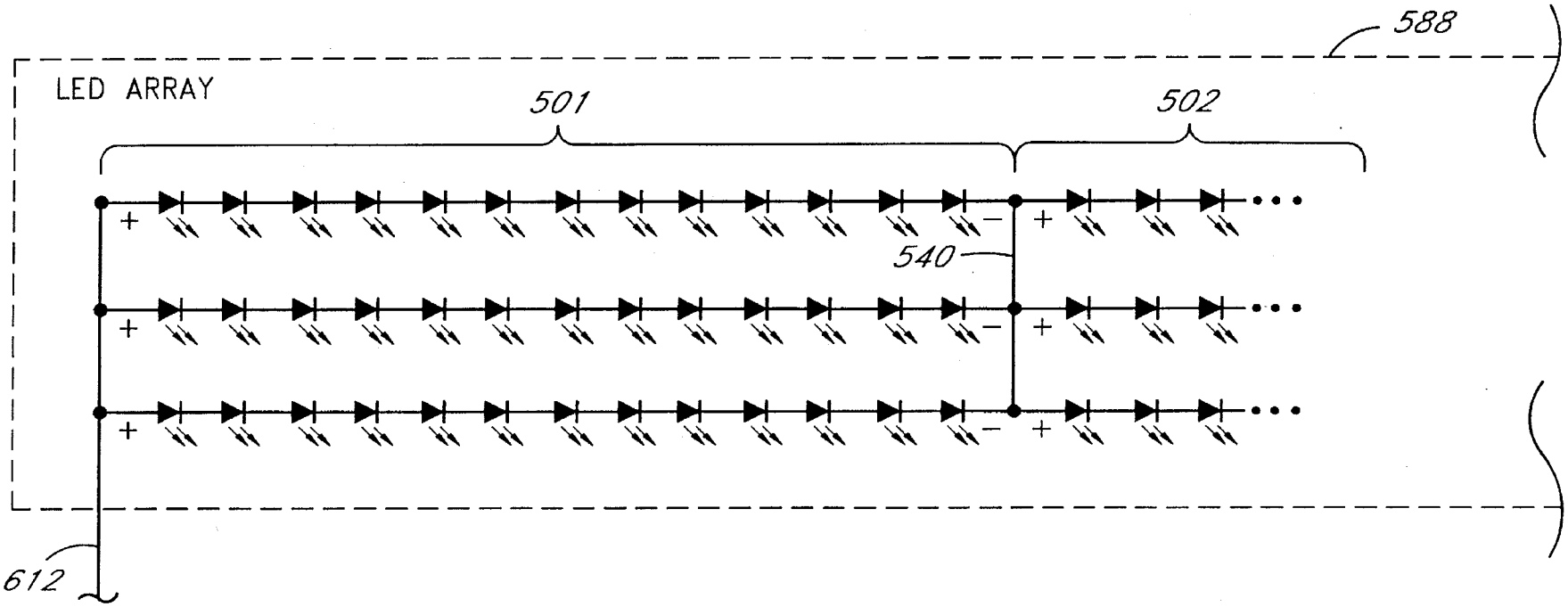
FIG. 9A is a detailed schematic diagram of LED array 501 and a portion of LED array 502 of FIG. 9.

FIG. 9A shows a schematic diagram of LED array 501, which is representative of the LED arrays 501 to 507 shown in FIG. 9. Each LED array 501 to 507 comprises three strings. Each string is comprised of a set of series connected LEDs. All of these strings in each array are in turn connected in parallel. Again by way of example, in the specific embodiment shown, the number of LEDs in every string of each array is as follows:

| LED Array | LEDs in Every String |
|---|---|
| 1 | 13 |
| 2 | 12 |
| 3 | 12 |
| 4 | 12 |
| 5 | 12 |
| 6 | 12 |
| 7 | 12 |

A series string of LEDs in array 501 is assembled as follows. An anode of a first LED is connected to the positive terminal of the array, which is connected to the DC power line 612. Next, a cathode of the first LED is connected to an anode of a second LED. Each subsequent LED of the string is connected in the same manner, a cathode of one LED connected to an anode of the next LED. After all of the LEDs in the string have been connected in this manner, a cathode of the last LED of the string is connected to the negative terminal of the array 501, which is connected to line 540. Each string in LED array 501 is assembled in this same manner, a series connection of LEDs, from anode to cathode, between the positive and negative terminals of the array, so as to create three identical strings of LEDs. In addition, the LED strings in each of the other LED arrays 502 to 507 are also assembled in this same manner, a series connection of LEDs, from anode to cathode, between the positive and negative terminals of the respective arrays.

As described above in reference to the first embodiment, the LEDs of the LED configuration and control circuitry 520 are divided into a relatively large number of LED arrays 501 to 507 so as to limit the number of LEDs that will be disabled because of a failure of one or more LEDs.

Referring again to FIG. 9, the line voltage power line 118 and line voltage return line 120 are also connected to a rectifier 700 which provides a reference voltage 594, representative of the voltage magnitude of the line voltage power line 118. The reference voltage output of the rectifier 700 is provided to both mid-voltage and low-voltage compensation circuits 582 and 584. Thus, the reference voltage 594 is connected to a mid-voltage detector 574 of the mid-voltage compensation circuit 582. The mid-voltage detector 574 compares the reference voltage 594 against a pre-defined intermediate voltage threshold.

The output of the mid-voltage detector 574 is connected to a control input terminal of a switch 576. Also, a line 533 is connected to a first data terminal of the switch 576, a line 534 is connected to a second data terminal of the switch 576, a line 535 is connected to a third data terminal of the switch 576, and the line 616 is connected to a fourth data terminal of the switch 576. When the mid-voltage detector 574 determines that the reference voltage 594 is less than the intermediate voltage threshold, the mid-voltage detector 574 will activate the switch 576 to effectively short the first data terminal to the second data terminal, and short the third data terminal to the fourth data terminal.

As described above, line 533 is connected to the positive terminal of LED array 506, while line 534 is connected to the positive terminal of LED array 507. The line 535 is connected to the negative terminal of LED array 506, while the line 616 is connected to the negative terminal of LED array 507. Thus, when the reference voltage 594 drops below the intermediate voltage threshold, the mid-voltage detector 574 activates the switch 576 to short the positive terminal of the LED array 506 to the positive terminal of LED array 507, and to short the negative terminal of LED array 506 to the negative terminal of LED array 507.

The low voltage compensation circuit 584 operates in a similar manner to the mid-voltage compensation circuit 582, but the compensation circuit 584 utilizes a different pre-defined voltage, the low voltage threshold. The reference voltage 594 generated by the rectifier 700 is also connected to a low voltage detector 578. The low voltage detector 578 compares the reference voltage 594 against the low voltage threshold. The output of the low voltage detector 578 is connected to a control input terminal of a switch 580. Also, a line 530 is connected to a first data terminal of the switch 580, a line 531 is connected to a second data terminal of the switch 580, a line 532 is connected to a third data terminal of the switch 580, and the line 533 is connected to a fourth data terminal of the switch 580. When the low voltage detector 578 determines that the reference voltage 594 is less than the low voltage threshold, the low voltage detector 578 will activate the switch 580 to effectively short the first data terminal to the second data terminal, and the third data terminal to the fourth data terminal. As described above, the line 530 is connected to the positive terminal of LED array 504, while the line 531 is connected to the positive terminal of LED array 505. The line 532 is connected to the negative terminal of the LED array 504, while the line 533 is connected to the negative terminal of LED array 505. Thus, when the reference voltage 594 drops below the low voltage threshold, the low-voltage detector 578 activates the switch 580 to short the positive terminal of LED array 504 to the positive terminal of LED array 505 and to short the negative terminal of LED array 504 to the negative terminal of LED array 505.

Similar to the first embodiment, the LED configuration and control circuitry 520 operates in one of three different modes, depending on the voltage differential provided across the line voltage power line 118 and the line voltage return line 120. If this input voltage is between the normal voltage and the intermediate voltage threshold, then the LED configuration and control circuitry 520 will be operating in the full voltage mode. If the input voltage is between the intermediate voltage threshold and the low voltage threshold, then the LED configuration and control circuitry 520 will be operating in the intermediate voltage mode. Finally, if the input voltage is below the low-voltage threshold, the LED configuration and control circuitry 520 will be operating in the low-voltage mode.

Figure 10A:
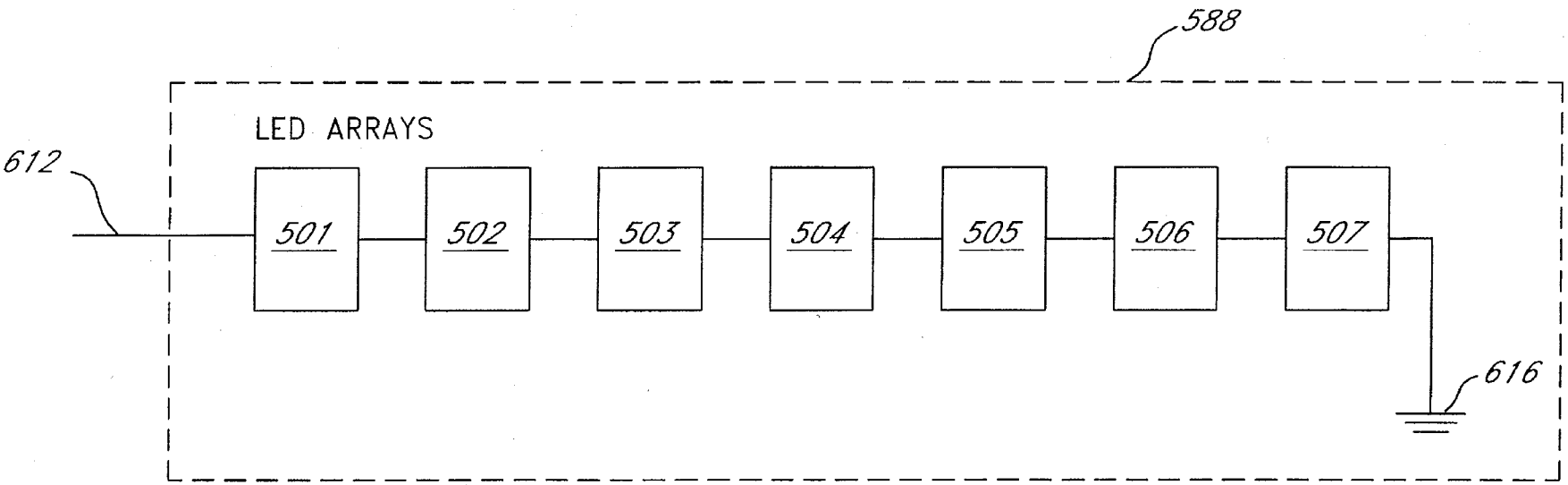
FIG. 10A is a functional block diagram of the effective arrangement of LED configuration 588 for a full voltage mode of operation.

When the LED configuration and control circuitry 520 is operating in the full voltage mode, the mid-voltage detector 574 and low-voltage detector 578 will deactivate the switches 576 and 580, respectively, so that the switches do not short any of the data terminals together. Thus, the mid-voltage compensation circuit 582 and the low voltage compensation circuit 584 will have a negligible effect on the operation of the LED configuration 588. Consequently, the current from the rectifier 572 will flow from the DC power line 612 through LED arrays 501, 502, 503, and 504, through diode 508, through LED arrays 505 and 506, through diode 509, and through LED array 507 to return to the rectifier 572 through the line 616. Therefore, the voltage generated by the rectifier 572 will effectively be placed across the series connection of LED arrays 501 to 507. In this specific embodiment, there will be 85 LED voltage drops between line 612 and line 616 during this full voltage mode. FIG. 10A shows a functional block diagram of the effective arrangement of the LED configuration 588 for this mode of operation. Each of the LEDs in LED arrays 501 through 507 will be illuminated with equal intensity.

When the input voltage is between the intermediate-voltage threshold and the low-voltage threshold, the low-voltage compensation circuit 584 will again have a negligible effect on the LED configuration 588. However, the mid-voltage compensation circuit 582 will short line 533 at the positive terminal of LED array 506 to line 534 at the positive terminal of LED array 507 and it will short line 535 at the negative terminal of LED array 506 to line 616 at the negative terminal of LED array 507. Thus, the current generated by the rectifier 572 will flow through the DC power line 612, through LED arrays 501, 502, 503 and 504, through diode 508, and through LED array 505. At this point in the circuit, the current will have two paths to get to the DC return line 616. Some of the current will flow through LED array 506 to the negative terminal of that array. However, this current will not continue to flow through LED array 507, because the switch 576 provides a less resistive path from the negative terminal of LED array 506, to the DC return line 616. The second path for the current flowing from LED array 505 is into the line 533, through the switch 576, and to the line 534. This current will then flow through the LED array 507 to the DC return line 616. The diode 509 prevents current from flowing from the line 534 directly to the DC return line 616 which is connected to the negative terminal of LED array 506. The current flowing through LED arrays 506 and 507 will be approximately equal because the total resistance of each of these paths will also be approximately equal.

Figure 10B:
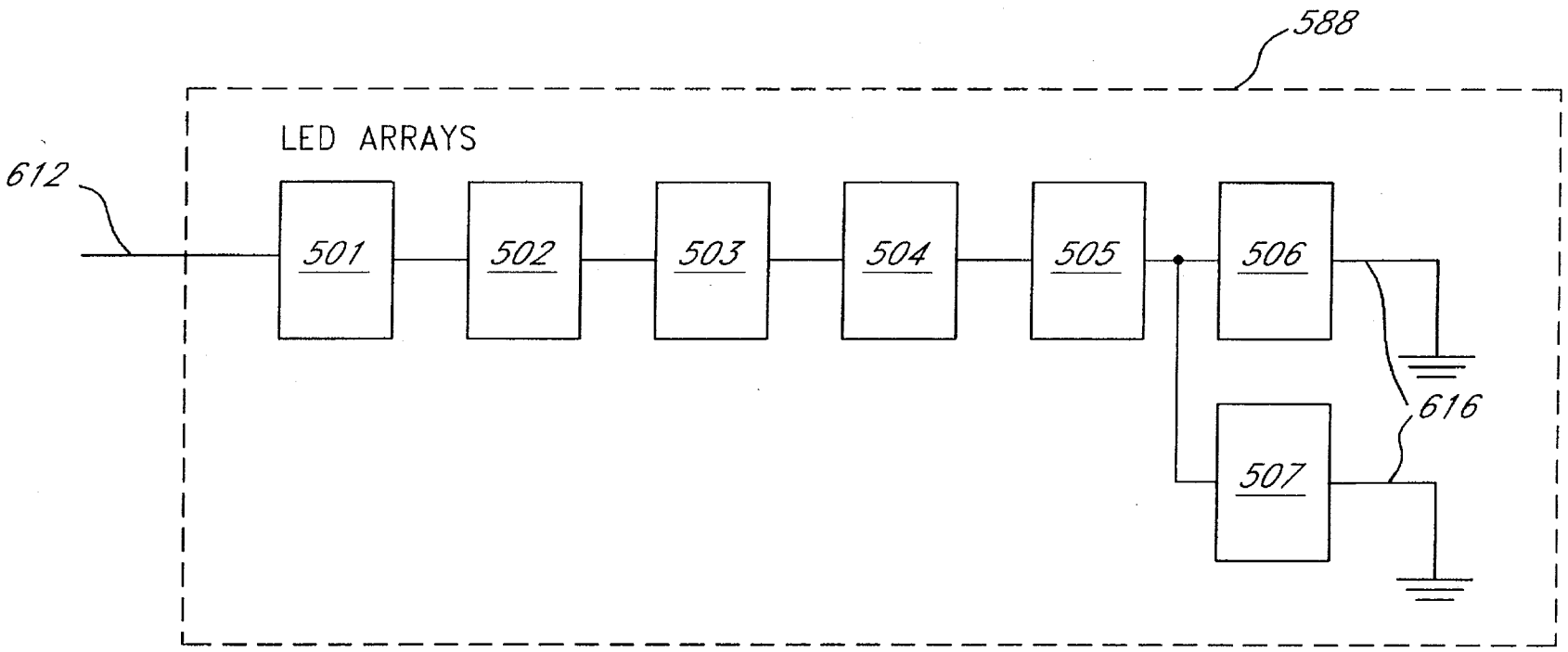
FIG. 10B is a functional block diagram of the effective arrangement of LED configuration 588 for an intermediate voltage mode of operation.

The effect of the mid-voltage compensation circuit 582 is to electronically rearrange the LED configuration 588 so that the LED array 507 is now effectively connected in parallel with LED array 506. The effective arrangement for the LED configuration 588 for this mode is shown in FIG. 10B. Rearranging the LED configuration 588 in this manner reduces the number of LED voltage drops between the DC power line 612 and the DC return line 616 by 12 for this specific embodiment. This results in an increased voltage drop across each LED, and consequently an increased current flow through the LED configuration 588, even though the total voltage across LED configuration 588 has decreased. All of this increased current will flow through LED arrays 501 through 505, while the current will be divided between LED arrays 506 and 507. Although the current flowing through LED arrays 506 and 507 is less than the current flowing through LED arrays 501 through 505, all of the LED arrays 501 through 507 appear to have the same brightness in a traffic signal incorporating this specific embodiment. Because of the increased voltage drop across each of the LEDs in LED arrays 501 through 505, and consequently the increased current flow, the LED arrays 501 to 507 are capable of generating sufficient light intensity despite the decrease in the input voltage.

When the input voltage drops below the low-voltage threshold, the low-voltage compensation circuit 584 will short line 530 at the positive terminal of LED array 504 to line 531 at the positive terminal of LED array 505, and it will short line 532 at the negative terminal of LED array 504 to line 533 at the negative terminal of LED array 505. In this mode, current generated by the rectifier 572 will flow through the DC power line 612 and through the LED arrays 501 through 503. At this point in the circuit, the current will have two different paths by which it can flow to line 533 at the positive terminal of LED array 506. Some current will flow through LED array 504 to line 532 at the negative terminal of that array. However, this current will not continue to flow through LED array 505 because the switch 580 provides a less resistive path from line 532 at the negative terminal of LED array 504 to line 533 at the negative terminal of LED array 505. The second path for the current flowing from the LED array 503 is into the line 530, through the switch 580, to the line 531, and through LED array 505. The diode 508 prevents current from flowing from the line 531 directly to line 533 at the positive terminal of LED array 506. Again, the current flowing through LED arrays 504 and 505 will be approximately equal.

Figure 10C:
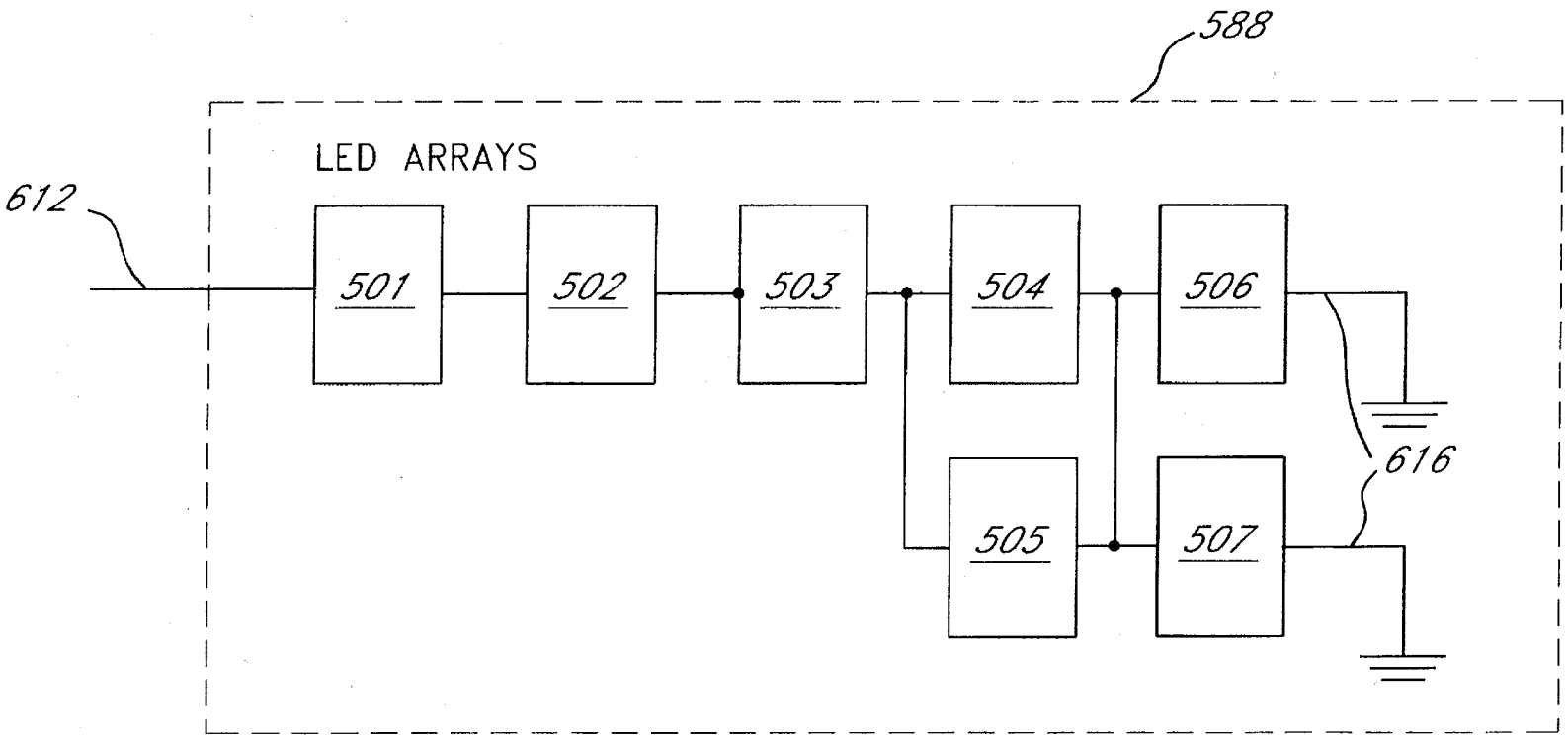
FIG. 10C is a functional block diagram of the effective arrangement of LED configuration 588 for a low voltage mode of operation.

The low voltage compensation circuit 584 operates to rearrange the LED arrays 504 and 505 so that they are connected in parallel between LED arrays 503 and 506. The mid-voltage compensation circuit 582 also operates to rearrange the LED arrays 506 and 507 so that they are connected in parallel. The LED configuration 588 is now effectively arranged as shown in FIG. 10C. Placing LED arrays 504 and 505 in parallel reduces the number of LED voltage drops between lines 612 and 616 by an additional 12 for this specific embodiment. Again, this will cause an increased voltage across each of the LEDs in arrays 501 to 503, which will cause an increase in the current flowing through the LED configuration 588, despite the decrease in total voltage across the LED configuration 588. All of this increased current will flow through LED arrays 501 through 503, while the current will be divided between LED arrays 504 and 505, and between LED arrays 506 and 507. Again, all of the LED arrays 501 through 507 appear to have the same brightness in a traffic signal light incorporating this embodiment. Also, the LED arrays 501 to 507 are capable of generating sufficient light intensity because of the increased current flow.

The number of LEDs in each of the arrays 501 to 507 is selected in the same manner as described above in reference to the first embodiment. Again, a traffic signal light using Toshiba TLRA155BP red LEDs in this specific embodiment will produce sufficient light for any input voltage between 90 volts and 120 volts.

Unlike the first embodiment of the present invention, all of the LEDs in this second embodiment remain illuminated in all three modes of operation. Therefore, this second preferred embodiment is very advantageous for use in a turn signal application. In such an application, the arrow design of the LEDs could be adversely affected by the turning off of selected LEDs. However, as indicated above, this second embodiment is also advantageously used for a traffic signal light with a solid, circular pattern of LEDs, as described in the first embodiment of the present invention.

Figure 11:
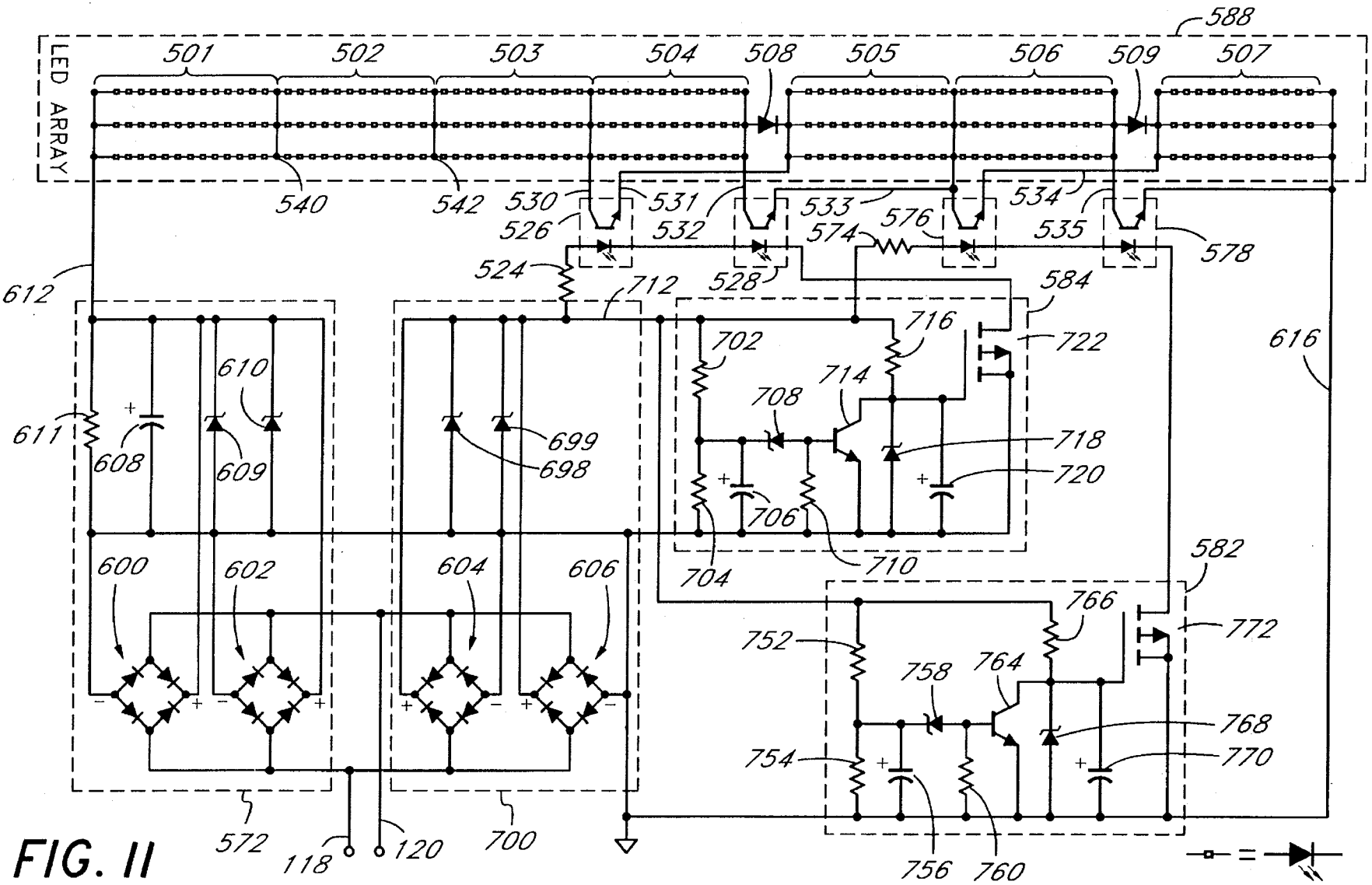
FIG. 11 is a schematic diagram of the second embodiment of the present invention.

Referring to FIG. 11, the rectifier 572, as described above with respect to FIG. 9, comprises a pair of dual in-line package (DIP) bridge rectifiers 600 and 602, a resistor 611, a capacitor 608, and a pair of zener diodes 609 and 610. The line voltage power line 118 is connected to a first AC input terminal of each of the DIP bridge rectifiers 600 and 602. The line voltage return line 120 is connected to a second AC input terminal of each of the DIP bridge rectifiers 600 and 602. A regulated DC power voltage is generated at a positive DC terminal of each of the two DIP bridge rectifiers 600 and 602 and applied to line 612. The regulated DC power is connected via line 612 to a cathode of each of the zener diodes 609 and 610, to a positive terminal of the capacitor 608 and to a first terminal of the resistor 611. A DC return path is provided by line 616 connected to a negative DC terminal of each of the two DIP bridge rectifiers 600 and 602. Lead 616 is connected to an anode of each of the two zener diodes 609 and 610, to a negative terminal of the capacitor 608 and to a second terminal of the resistor 611. The regulated DC voltage on line 612 is connected to the positive terminal of LED array 501, as described above with respect to FIGS. 9 and 9A. The remaining LED arrays 502 to 507 are also connected as described above, with the negative terminal of LED array 507 connected to the DC return line 616. The operation of the rectifier 572 is the same as the operation of the rectifier 72 of the first embodiment.

Still referring to FIG. 11, the second rectifier 700, described above with respect to FIG. 9, comprises a pair of DIP bridge rectifiers 604 and 606 and a pair of zener diodes 698 and 699. The line voltage power line 118 is connected to a first AC input terminal of each of the DIP bridge rectifiers 604 and 606. The line voltage return line 120 is connected to a second AC input terminal of each of the DIP bridge rectifiers 604 and 606. A positive DC output terminal of each of the DIP bridge rectifiers 604 and 606 generates a first regulated DC reference voltage on line 712. The regulated DC reference on line 712 is connected to a cathode of each of the zener diodes 698 and 699. An anode of each of the zener diodes 698 and 699 and a negative DC output terminal of each of the DIP bridge rectifiers 604 and 606 are all connected to the DC return line 616. The rectifier 700 operates in the same manner as the rectifier 200 of the first embodiment.

The mid-voltage compensation circuit 582, described above with respect to FIG. 9, comprises, as shown in FIG. 11, four resistors 752, 754, 760 and 766; two capacitors 756 and 770; two zener diodes 758 and 768; a bipolar transistor 764; and a Field Effect Transistor (FET) 772. The regulated DC reference voltage on line 712 is connected to a first terminal of the resistor 752 and to a first terminal of the resistor 766. A second terminal of the resistor 752 is connected to a first terminal of the resistor 754, a positive terminal of the capacitor 756 and a cathode of the zener diode 758. A second terminal of the resistor 754 and a negative terminal of the capacitor 756 are connected to the DC return line 616. An anode of the zener diode 758 is connected to a first terminal of the resistor 760 and to a base terminal of the transistor 764. A second terminal of the resistor 760 and an emitter terminal of the transistor 264 are connected to the DC return line 616. A collector terminal of the transistor 764 is connected to a second terminal of the resistor 766, to a cathode of the zener diode 768, to a positive terminal of the capacitor 770 and to a gate terminal of the transistor 772. An anode of the zener diode 768, a negative terminal of the capacitor 770 and a source terminal of the transistor 772 are all connected to the DC return line 616.

A drain terminal of the transistor 772 is connected to a negative control terminal of an opto-isolated transistor 578. A positive control terminal of the opto-isolated transistor 578 is connected to a negative control terminal of an opto-isolated transistor 576. A positive control terminal of the opto-isolated transistor 576 is connected to a first terminal of a resistor 574. A second terminal of the resistor 574 is connected to the regulated DC reference line 712. A source terminal of the opto-isolated transistor 578 is connected to the DC return line 616. A drain terminal of the opto-isolated transistor 578 is connected to a line 535, which is, in turn, connected to the negative terminal of LED array 506 and to the anode of diode 509. A source terminal of the opto-isolated transistor 576 is connected to a line 534, which is, in turn, connected to the positive terminal of LED array 507 and to the cathode of diode 509. A drain of the opto-isolated transistor 576 is connected to a line 533, which is, in turn, connected to the positive terminal of LED array 506 and to the negative terminal of LED array 505.

The low voltage compensation circuit 584, described above with respect to FIG. 9, comprises, as shown in FIG. 11, four resistors 702,704, 710 and 716; two capacitors 706 and 720; two zener diodes 708 and 718; a bipolar transistor 714; and a FET 722. The regulated DC reference line 712 is connected to a first terminal of the resistor 702 and to a first terminal of the resistor 716. A second terminal of the resistor 702 is connected to a first terminal of the resistor 704, to a positive terminal of the capacitor 706 and to a cathode of the zener diode 708. A second terminal of the resistor 704 and a negative terminal of the capacitor 706 are both connected to the DC return line 616. An anode of the zener diode 708 is connected to a first terminal of a resistor 710 and to a base terminal of the transistor 714. A second terminal of the resistor 710 and an emitter terminal of the transistor 714 are both connected to the DC return line 616. A collector terminal of the transistor 714 is connected to a second terminal of the resistor 716, to a cathode of the zener diode 718, to a positive terminal of the capacitor 720 and to a gate terminal of the transistor 722. An anode of the zener diode 718, a negative terminal of the capacitor 720, and a source terminal of the transistor 722 are all connected to the DC return line 616.

A drain terminal of the transistor 722 is connected to a negative control terminal of an opto-isolated transistor 528. A positive control terminal of the opto-isolated transistor 528 is connected to a negative control terminal of an opto-isolated transistor 526. A positive control terminal of the opto-isolated transistor 526 is connected to a first terminal of a resistor 524. A second terminal of the resistor 524 is connected to the regulated DC reference line 712. A source terminal of the opto-isolated transistor 528 is connected to the line 533. A drain terminal of the opto-isolated transistor 528 is connected to a line 532, which is, in turn, connected to the negative terminal of LED array 504 and to an anode of diode 508. A source terminal of opto-isolated transistor 526 is connected to a line 531, which is, in turn, connected to the positive terminal of LED array 505 and to the cathode of diode 508. A drain terminal of the opto-isolated transistor 526 is connected to a line 530, which is, in turn, connected to the positive terminal of LED array 504 and to the negative terminal of LED array 503.

The above discussion of the voltage compensating circuits 82 and 84 of the first embodiment also applies to the voltage compensating circuits 582 and 584 of the second embodiment, except for part of the discussion related to transistors 272 and 222. The operation of transistors 772 and 722 will be described below.

An opto-isolated transistor operates in a manner that is similar to an ordinary transistor. If a required voltage differential is placed across the positive and negative control terminals of an opto-isolated transistor, then the transistor will be biased in its saturation region. If, on the other hand, a sufficient voltage is not placed across the control terminals, the transistor will be in its cut-off region. The opto-isolated transistor is advantageous over an ordinary transistor because the voltage applied to control the conductivity between the drain and the source need not be related to the voltages applied at the drain and source terminals.

Referring again to FIG. 11, when the input voltage is above the intermediate voltage threshold so that the transistor 772 is turned off, the negative control terminal of the opto-isolated transistor 578 will not be pulled low enough to cause a sufficient voltage differential across the control terminals of opto-isolated transistors 576 and 578. Therefore, opto-isolated transistors 576 and 578 will be turned off. Similarly, the transistor 722 will be turned off so that the negative control terminal of opto-isolated transistor 528 is not pulled low enough to turn on the opto-isolated transistors 526 and 525. Under these circumstances, the voltage compensating circuits 582 and 584 will have a negligible effect on the operation of LED configuration 588. The LED configuration 588 will effectively constitute a serial string of LED arrays 501 to 507, as shown in FIG. 10A.

When the input voltage drops below the intermediate-voltage threshold and the mid-voltage compensation circuit turns on the transistor 772, the negative control terminal of the opto-isolated transistor 578 will be effectively grounded. This will produce a positive voltage differential across the resistor 574, the control terminals of optoisolated transistor 576 and the control terminals of the opto-isolated transistor 578 of sufficient magnitude to turn on the opto-isolated transistors 576 and 578. The opto-isolated transistor 578 creates a very low resistance path between the line 535 and the DC return line 616. The opto-isolated transistor 576 produces a very low resistance path between lines 533 and 534. As described above in reference to FIG. 10B, the combined effect of the opto-isolated transistors 576 and 578 is to rearrange LED arrays 506 and 507 so that they are effectively connected in parallel. Again, the diode 509 prevents current from flowing directly from line 534 at the positive terminal of LED array 507 to the DC return line 616.

When the input voltage drops below the low voltage threshold and the low voltage compensating circuit 584 turns on the transistor 722, the negative control terminal of the opto-isolated transistor 528 is effectively pulled to ground. This produces a positive voltage differential across a resistor 524, the control terminals of the opto-isolated transistor 526 and the control terminals of the opto-isolated transistor 528 of sufficient magnitude to turn on the opto-isolated transistors 526 and 528. Opto-isolated transistor 528 provides a very low resistance path between lines 532 and 533, while opto-isolated transistor 526 provides a very low resistance path between lines 530 and 531. As described above in reference to FIG. 10C, the combined effect of opto-isolated transistors 526 and 528 is to electronically rearrange LED arrays 504 and 505 so that they are effectively connected in parallel. Opto-isolated transistors 576 and 578 will also operate to configure LED arrays 506 and 507 into a parallel connection because the mid-voltage compensating circuit 582 will turn on the transistor 772 which will turn on opto-isolated transistors 576 and 578. Again, the diode 508 prevents current from flowing directly from line 531 at the positive terminal of LED array 505 to line 533 at the positive terminal of LED array 506.

The second embodiment of the present invention will achieve results that are similar to the results described above with reference to the first embodiment. A graph of the light intensity generated by the second embodiment for a variety of input supply voltages would be similar to the graph shown in FIG. 7, although the magnitudes would be decreased because of the decreased number of LEDs. The second embodiment has many of the same features of the first embodiment, and it has the additional advantage of compensating for a reduced input voltage without disabling any of the LEDs.

Both of the preferred embodiments of the present invention described above can be used to easily replace standard incandescent light bulbs in existing traffic signals. Referring again to FIG. 2A, the wing nuts 24 are loosened and rotated away from the hinged cover 18, so that the hinged cover 18 can be rotated away from the traffic light enclosure 22. A standard incandescent light bulb (not shown) will be mounted inside the traffic light assembly 14, and will swing out with the hinged cover 18. The incandescent light bulb will have an electrical cable (not shown) protruding from the rear portion of the light bulb. The connectors (not shown) at the end of this cable must be removed from a terminal block (not shown) in the traffic signal 13. Next, the clips 23, which retain the incandescent light bulb, are loosened by turning the mounting screws 26 in a counter-clockwise direction. The incandescent light bulb can then be removed from the light assembly The LED traffic signal light 17 can be placed in the same location that was previously occupied by the incandescent light bulb, and the mounting screws 26 can be tightened so that the clips 23 will retain the LED traffic signal light 17 against the hinged cover 18. The ring terminals 27 (or similar connectors) are attached to the terminal block of the traffic signal 13. The exact connection that must be made will depend on the wiring and the connectors of the traffic signal 13. These details will be well understood by one of ordinary skill in the art. Next, the hinged cover 18 can be rotated to a closed position against the traffic light enclosure 22, and the wing nuts 24 can be rotated toward the hinged cover 18 and tightened to secure the hinged cover 18.

The traffic signal 13 will now operate in the same manner as if the standard incandescent light bulb were still being used. However, the new LED traffic signal light 17 will consume much less energy and will be much more reliable than the old incandescent bulb. In fact,each of the two specific embodiments described above consumes only 0.4 watts of electrical power.

Although the present invention has been described with reference to two specific embodiments, it is to be understood that the scope of this invention is not limited to these embodiments. Numerous modifications may be made to these embodiments, and other arrangements may be devised by those skilled in the art without departing from the spirit and scope of the invention.

We claim:

1. A LED traffic signal light having both a mechanical external size and shape configuration and at least two electrical operational modes so that existing traffic lights retrofitted with said LED lights have reduced light diminution in comparison with conventional LED traffic signal lights during electrical brown-out periods in which the input line voltage drops from a normal input line voltage to a voltage below a threshold value, said LED traffic signal light comprising:

a plurality of LEDs retained in a mechanical configuration that is compatible with the housing of the conventional traffic signal light to be retrofitted;

said LEDs being connected in a plurality of series connected strings so that when said strings are connected in parallel across a DC voltage derived from an input line voltage, each of said LEDs has a voltage applied across its terminals which produces a light output from said traffic signal light equal to or above a predetermined light intensity for normal line voltage;

a voltage detector device detecting whenever the input line voltage falls below the threshold voltage required to drive said LEDs to produce said predetermined light intensity for said traffic signal light;

a switching device coupled to said voltage detector and to said plurality of series connected strings of LEDS so that when said voltage detector device detects a drop in said input line voltage below said threshold voltage, said voltage detector device sends a signal to said switching device and said switching device is automatically activated to electrically rearrange said configuration of LEDs by reducing the number of LEDs in each of said series strings so that each of the then energized LEDs receives a voltage above a minimum voltage necessary to maintain said light output equal to or above said predetermined light intensity for said traffic signal light during periods in which the input line voltage drops below said threshold value; and said switching device automatically returning said configuration of LEDs to its normal arrangement when the line voltage rises above said threshold value.

2. The LED traffic signal light of claim 1 wherein said switching device responsively coupled to said voltage detector device automatically electrically (i) converts a series string of n LEDs into a circuit comprising at least two series LED strings, each having less than n LEDs and (ii) connects in parallel across the DC voltage said series LED strings having less than n LEDs.

3. The LED traffic signal light of claim 1 wherein said switching device connected to said voltage detector device automatically shorts out one or more LEDs in a series string to reduce the number of LEDs in said string.

4. The LED traffic signal light of claim 3 wherein said switching device shorts out a sufficient number of LEDs in said series string so that the remaining LEDs are energized at a higher voltage and as a result, each such LED emits an increased intensity light compared to the light intensity emitted when the input line has a voltage of normal magnitude, said increased intensity light designed to compensate for the fact that some of the LEDs in the configuration are shorted out.

5. The LED traffic signal light of claim 3 wherein the shorted out LEDs are included in the outer perimeter of said configuration.

6. A LED traffic signal light having both a mechanical external size and shape configuration and at least two electrical operational modes so that existing traffic lights retrofitted with said LED lights have reduced light diminution in comparison with conventional LED traffic signal lights during periods in which the input line voltage drops below a threshold value, said LED traffic signal light comprising:

a plurality of LEDs retained in a mechanical configuration that is compatible with the housing of the conventional traffic signal light to be retrofitted;

said LEDs being connected in a plurality of series connected strings so that when said strings are connected in parallel across a voltage derived from said input line voltage, each of said LEDs has a sufficient voltage applied across its terminals to produce a predetermined light output for said traffic signal light;

detector device for determining whenever the input line voltage falls below said threshold voltage;

a switching device connected to said detector device and to said series connected strings of LEDs, for automatically electrically rearranging said configuration of LEDs so that a reduced number of LEDs each receives a voltage above a preset minimum voltage such that the drop in total light intensity for said traffic signal light during periods in which the input line voltage drops below said threshold value is less then if the LEDs were not reconfigured; and said switching means automatically returning said configuration of LEDs to its normal configuration when the line voltage rises above said threshold value.

7. The LED traffic signal light of claim 6 wherein said switching device upon receipt of said signal from said detector device automatically electrically (i) converts a series string of n LEDs into a circuit comprising at least two series LED strings, each having less than n LEDs and (ii) connects in parallel across the DC voltage said series LED strings having less than n LEDs.

8. The LED traffic signal light of claim 6 wherein said switching device connected to said detector device, said switching device automatically shorts out one or more LEDs in a series string to reduce the number of LEDs in said string.

9. The LED traffic signal light of claim 6 wherein the operation of said voltage detector device is unaffected by variations in ambient temperature.

10. The LED traffic signal light of claim 6 wherein said plurality of LEDs is physically arranged to form a solid circular pattern.

11. The LED traffic signal light of claim 6 wherein said plurality of LEDs is physically arranged to form the shape of an arrow.

12. A LED traffic signal light having both a mechanical external size and shape configuration and at least two electrical operational modes so that existing traffic lights retrofitted with said LED lights have reduced light diminution in comparison with conventional LED traffic signal lights during periods in which the line voltage drops below a threshold value said LED traffic signal light comprising:

a plurality of LEDs retained in a mechanical configuration that is compatible with the housing of the conventional traffic signal light to be retrofitted;

said LEDs being connected in a plurality of series connected strings so that when said strings are connected in parallel across a voltage derived from an input line voltage, each of said LEDs has a voltage applied across its terminals said voltage above a minimum necessary to produce a predetermined light output for said traffic signal light;

detector device for determining whenever the input line voltage falls below a threshold voltage which is the voltage required to drive said LEDs to produce the predetermined light output for said traffic signal light;

switching device connected to said detector device and to said series connected strings of LEDs, said detector device automatically electrically rearranges said configuration of LEDs so that a sufficient number of LEDs receive sufficient voltage to maintain the predetermined light output for said traffic signal light.

13. A LED traffic signal light having both a mechanical external size and shape configuration and at least two electrical operational modes so that existing traffic lights can be retrofitted with said LED light, said LED traffic signal light comprising:

a plurality of LEDs retained in a mechanical configuration that is compatible with the housing of the conventional traffic signal light to be retrofitted;

said LEDs being connected in a plurality of series connected strings so that when said strings are connected in parallel across a voltage derived from an input line voltage, each of said LEDs has a voltage applied across its terminals, which voltage is above a minimum necessary to produce a predetermined light output for said traffic signal light;

a detector device which detects that the input line voltage has fallen below the voltage required to drive said LEDs to produce the predetermined light output for said traffic signal light; and switching device connected to said detector device and to said series connected string of LEDs for automatically electrically rearranging said configuration of LEDs so that a sufficient number of LEDs receive the voltage necessary to maintain the predetermined light output for said traffic signal light during periods of reduced input line voltage.

14. A LED traffic signal light having both a mechanical external size and shape configuration and at least two electrical operational modes so that existing traffic lights can be retrofitted with said LED light, said LED traffic signal light comprising:

a plurality of LEDs arranged in a first electrical configuration which is selected to produce a predetermined light output for said traffic signal light for a normal input line voltage;

said plurality of LEDs being selectively illuminated in said first electrical configuration to form a first geometric pattern;

a detector device for determining whenever the input line voltage falls below a level required to drive said LEDs to produce the predetermined light output for said traffic signal light for said first electrical configuration;

a switching device connected to said detector device and said LEDs for automatically electrically rearranging said plurality of LEDs into a second electrical configuration which is selected to produce the predetermined light output for said traffic signal light for a reduced input line voltage;

said plurality of LEDs being selectively illuminated in said second electrical configuration to form a second geometric pattern; and said switching means automatically returning said plurality of LEDs into said first electrical configuration when the input line voltage rises above the voltage required to produce the predetermined light output for said traffic signal light in said first electrical configuration.

15. A LED traffic signal light having both a mechanical external size and shape configuration and at least three electrical operational modes so that existing traffic lights can be retrofitted with said LED light said LED traffic signal light comprising:

a plurality of LEDs retained in a mechanical configuration that is compatible with the housing of the conventional traffic signal light to be retrofitted;

said LEDs being connected in a plurality of series connected strings so that when said strings are connected in parallel across a DC voltage derived from the input line voltage, and the input line voltage is within a full voltage range, said LEDs are connected in a first LED arrangement and each of said LEDs has a voltage applied across its terminals such that said voltage is above said threshold necessary to produce a predetermined light output for said traffic signal light;

a mid-voltage detector device for determining whenever the input line voltage falls below said full voltage range into a mid-voltage range, in which the input line voltage is below the voltage required to drive said configuration of LEDs in said first LED arrangement to produce said predetermined light output for said traffic signal light;

mid-voltage switching means connected to said mid-voltage detector device and to said LEDs for automatically electrically rearranging said configuration of LEDs by reducing the number of LEDs in each of said series strings to obtain a second LED arrangement in which each of the then energized LEDs receives sufficient voltage to maintain the predetermined light output for said traffic signal light when the input line voltage is within said mid-voltage range;

said mid-voltage switching device automatically returning said configuration of LEDs to said first LED arrangement when said mid-voltage condition terminates and the line voltage returns to the full voltage range;

low-voltage detector device for determining whenever the input line voltage falls below said mid-voltage range into a low-voltage range, in which the input line voltage is below the voltage required to drive said configuration of LEDs in said second LED arrangement to produce the predetermined light output for said traffic signal light;

low-voltage switching means connected to said low-voltage detector device and to said LEDs for automatically electrically rearranging said configuration of LEDs by further reducing the number of LEDs in each of said series strings to obtain a third LED arrangement in which each of the then energized LEDs receives sufficient voltage to maintain the predetermined light output for said traffic signal light when the input line voltage is within said low-voltage range; and said low-voltage switching device automatically returning said configuration of LEDs to said second LED arrangement when said low-voltage condition terminates and the line voltage returns to the mid-voltage range.

16. A LED traffic signal light for replacing conventional incandescent bulb traffic signal lights, said LED traffic signal light having a size and shape designed for mounting in conventional traffic signals, said LED traffic signal light generating adequate light from a line voltage to operate as a signal device for controlling traffic at a street intersection, said traffic signal light comprising:

a first set of LEDs said first set of LEDs being energized by said line voltage;

a second set of LEDs, a low voltage compensation circuit electrically coupled to said line voltage and said second set of LEDs, said compensation circuit turning on said second set of LEDs when said input line voltage remains above a predetermined threshold voltage, said compensation circuit disconnects said second set of LEDs from said line voltage when said line voltage drops below said predetermined threshold voltage;

said first set of LEDs configured to generate at least a predetermined light intensity when the input line voltage is below said predetermined threshold voltage;

said second set of LEDs configured with said first set of LEDs so that said first and second sets of LEDs, combined, generate adequate light when the input line voltage is above the predetermined threshold voltage.

17. A LED traffic signal light for replacing conventional incandescent bulb traffic signal lights, said LED traffic signal light having a size and shape designed for mounting in conventional traffic signals, said LED traffic signal light generating adequate light to operate as a signal device for controlling traffic at street intersections, said traffic signal light comprising:

a plurality of LEDs comprising at least a first set of LEDs and a second set of LEDs for generating said light;

a low voltage compensation circuit electrically connected to said plurality of LEDs, said compensation circuit electrically arranges said first set of LEDs and said second set of LEDs into a serial configuration when an input line voltage is above a threshold voltage and into a parallel configuration when the input line voltage is below the threshold voltage, said serial configuration of LEDs producing more than a predetermined light output when the input line voltage is above the threshold voltage and said parallel configuration of LEDs generating said adequate light output when the input line voltage is below the threshold voltage.

18. The LED traffic signal light of claim 17, wherein said low voltage compensation circuit comprises:

a voltage detector circuit for determining whether the input line voltage is less than said predetermined threshold voltage;

a switch for electrically arranging said first set of LEDs and said second set of LEDs into said parallel configuration when said input line voltage is less than said predetermined threshold voltage, and for electrically arranging said first set of LEDs and said second set of LEDs into said serial configuration otherwise.

19. The LED traffic signal light of claim 17, wherein said plurality of LEDs is physically arranged in a pattern of concentric circles.

20. The LED traffic signal light of claim 19, wherein said plurality of LEDs is arranged so as to be more concentrated near the center of said pattern of concentric circles.

21. The LED traffic signal light of claim 17, wherein said plurality of LEDs is physically arranged to form the shape of an arrow.

22. The LED traffic signal light of claim 17, wherein said plurality of LEDs is divided into at least four LED arrays to reduce the number of LEDs that are disabled by an open circuit failure of a LED.

23. The LED traffic signal light of claim 17, wherein a failure of a component in the voltage compensating circuit will not affect the operation of the traffic signal light when said input voltage has a magnitude above a predefined minimum.

24. A LED traffic signal light automatically responsive to input changes in line voltage for producing predetermined light output comprising:

a first and a second set of LEDs for generating said predetermined light output; and a voltage compensation circuit means connected to said line input voltage and to said first and second set of LEDs for increasing an electrical current flowing through said first set of LEDs "without increasing electrical current flowing through said second set of LEDs" to compensate for a decrease in said input line voltage so that said LED traffic signal light maintains said predetermined light output.

25. A LED traffic signal light providing a predetermined light output during a decrease in power voltage to below normal line voltage, said signal light comprising:

a series string of LEDs placed across said power voltage, so that each of said LEDs has a predetermined voltage drop during normal line voltage and the number of voltage drops is equal to the number of LEDs in said series string; and a voltage compensation circuit connected to said series string of LEDs, to short to ground some of the LEDs to reduce the number of LEDs and the number of voltage drops in said series string in response to said decrease in said power voltage to below normal line voltage so that said reduced number of LEDs are in series across said power voltage and each of said reduced number of LEDs has said predetermined voltage drop across LEDs such that to maintain said predetermined light output.

26. A method for providing and maintaining a LED signal light for controlling traffic at a street intersection, having reduced light diminution during an electrical brown-out period when the normal input line voltage is reduced, said method comprising the steps of:

removing an incandescent light bulb from an existing traffic signal; and replacing the incandescent light bulb with a LED traffic signal light, said LED traffic signal light providing at least the following steps:

placing a voltage, derived from an input line voltage, across a plurality of LEDs arranged in a first configuration, said first configuration comprising a plurality of series connected strings of LEDs so that, at normal input line voltage, each of said LEDs has a voltage applied across its terminals to produce a predetermined light output for said LED traffic signal light;

detecting electrical brown-out period by detecting when the input line voltage falls below a threshold voltage defined as the voltage required to drive said plurality of LEDs when arranged in said first configuration to produce said predetermined light output for said LED traffic signal light;

electrically rearranging a plurality of said LEDs into a second configuration when the input line voltage falls below said threshold voltage, so that a voltage, derived from said input line voltage is placed across said rearranged LEDs and each of said rearranged LEDs has a voltage applied across its terminals to energize each of the LEDs in said second configuration to maintain light output from said LED traffic signal light during said electrical brown-out period; and automatically returning said plurality of LEDs to their first configuration when said brown-out period terminates and the line voltage increases to normal.

27. A method for utilizing an input line voltage to generate a sufficient light output to control traffic at a street intersection, regardless of variations in said input line voltage between a normal voltage and a reduced line brown-out voltage, said method comprising the steps of:

placing a voltage, derived from said input line voltage, across a plurality of LEDs arranged in a first configuration, said first configuration selected so that, at normal input line voltage, each of said LEDs has a sufficient voltage applied across its terminals to produce a predetermined light output for controlling traffic;

detecting whenever the input line voltage falls below a threshold voltage defined as the voltage required to drive said plurality of LEDs when arranged in said first configuration to produce said predetermined light output;

electrically rearranging a plurality of said LEDs into a second configuration when said input line voltage falls below said threshold voltage, said second configuration selected so that each of said rearranged LEDs has a voltage applied across its terminals to energize each of the LEDs in said second configuration to maintain light output during periods of reduced line voltage during electrical brown-out; and automatically returning said plurality of LEDs to said first configuration when said input line voltage rises above said threshold voltage.

* * * * *